US010907648B2

(12) United States Patent
Vogiatzis

(10) Patent No.: US 10,907,648 B2
(45) Date of Patent: Feb. 2, 2021

(54) AIRFOIL WITH MAXIMUM THICKNESS DISTRIBUTION FOR ROBUSTNESS

(71) Applicant: HONEYWELL INTERNATIONAL INC., Morris Plains, NJ (US)

(72) Inventor: Constantinos Vogiatzis, Gilbert, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 711 days.

(21) Appl. No.: 15/671,407

(22) Filed: Aug. 8, 2017

(65) Prior Publication Data

US 2018/0119706 A1 May 3, 2018

Related U.S. Application Data

(63) Continuation-in-part of application No. 15/338,026, filed on Oct. 28, 2016.

(51) Int. Cl.
*F04D 29/38* (2006.01)
*F04D 29/32* (2006.01)

(52) U.S. Cl.
CPC ..... *F04D 29/384* (2013.01); *F04D 29/324* (2013.01); *F04D 29/325* (2013.01)

(58) Field of Classification Search
CPC .... F04D 29/325; F04D 29/324; F04D 29/384; F01D 5/141
See application file for complete search history.

(56) References Cited

U.S. PATENT DOCUMENTS 3,012,709 A * 12/1961 Schnell ..... F01D 5/141 416/236 R
4,108,573 A * 8/1978 Wagner ..... F01D 5/141 416/236 A
5,395,071 A 3/1995 Felix
6,358,012 B1 3/2002 Staubach
(Continued)

FOREIGN PATENT DOCUMENTS

EP 1510652 A2 3/2005
EP 2816430 A1 12/2014
(Continued)

OTHER PUBLICATIONS

Extended EP Search Report for Application No. 18187398.5 dated Jan. 4, 2019.

*Primary Examiner* — Ninh H. Nguyen
*Assistant Examiner* — Aye S Htay
(74) *Attorney, Agent, or Firm* — Lorenz & Kopf, LLP

(57) ABSTRACT

A fan blade for a gas turbine engine includes an airfoil that has a first chord line that extends from a leading edge to a trailing edge. The first chord line is at 0% at the leading edge and at 100% at the trailing edge. The airfoil has a first local maximum thickness defined between about 85% of a span to a tip, a second local maximum thickness defined between about 40% to about 85% of the span and a third local maximum thickness defined between a root to about 40% of the span. The second local maximum thickness is positioned at about 10% to about 30% of the first chord line so as to be offset from the first local maximum thickness in the chord-wise direction toward the leading edge. Each of the first, second and third local maximum thicknesses are different.

20 Claims, 14 Drawing Sheets

(56) References Cited

U.S. PATENT DOCUMENTS

| | | | | |
|---|---|---|---|---|
| 6,565,324 | B1 * | 5/2003 | Phillipsen | F01D 5/141 416/236 R |
| 6,837,679 | B2 | 1/2005 | Kawarada et al. | |
| 6,905,309 | B2 * | 6/2005 | Nussbaum | F01D 5/10 29/889.1 |
| 7,090,463 | B2 | 8/2006 | Milburn et al. | |
| 8,393,872 | B2 | 3/2013 | Kirtley | |
| 9,046,111 | B2 | 6/2015 | Harvey et al. | |
| 9,188,017 | B2 | 11/2015 | Xu | |
| 10,408,070 | B2 * | 9/2019 | Mahias | F01D 5/16 |
| 2011/0097210 | A1 | 4/2011 | Kirtley | |
| 2011/0206527 | A1 | 8/2011 | Harvey et al. | |
| 2012/0061522 | A1 | 3/2012 | Sullivan et al. | |
| 2013/0164488 | A1 | 6/2013 | Wood et al. | |
| 2015/0354367 | A1 | 12/2015 | Gallagher et al. | |
| 2016/0024930 | A1 | 1/2016 | Aaron et al. | |
| 2016/0146012 | A1 | 5/2016 | Warikoo et al. | |
| 2017/0234134 | A1 * | 8/2017 | Bunker | F04D 29/681 415/208.2 |

FOREIGN PATENT DOCUMENTS

| | | | |
|---|---|---|---|
| EP | 3315722 | A1 | 5/2018 |
| GB | 2403779 | A | 1/2005 |

* cited by examiner

AIRFOIL WITH MAXIMUM THICKNESS DISTRIBUTION FOR ROBUSTNESS

CROSS-REFERENCE TO RELATED APPLICATION

This application is a continuation-in-part of U.S. patent application Ser. No. 15/338,026 filed on Oct. 28, 2016. The relevant disclosure of the above application is incorporated herein by reference.

TECHNICAL FIELD

The present disclosure generally relates to gas turbine engines, and more particularly relates to a fan blade structure having an airfoil with a maximum thickness distribution that provides robustness to the fan blade structure.

BACKGROUND

Gas turbine engines may be employed to power various devices. For example, a gas turbine engine may be employed to power a mobile platform, such as an aircraft, rotorcraft, etc. In the example of the gas turbine engine powering a mobile platform, components of the gas turbine engine may, in certain instances, encounter a foreign object during operation. In these instances, the components of the gas turbine engine may be required to continue to operate after this encounter or may be required to shut down safely. In certain instances, the gas turbine engine may be required to withstand multiple encounters with foreign objects. In the example of a fan blade structure, the fan blade structure may be required to withstand the encounter with minimal deformation. Generally, in order to ensure the fan blade structure withstands the encounter, the airfoil may have an increased overall thickness to provide robustness to the airfoil. The increased overall thickness, however, increases the weight of the airfoil, and thus, the fan blade structure, which is undesirable for the operation of the gas turbine engine.

Accordingly, it is desirable to provide a blade structure, such as fan blade structure, having an airfoil with a maximum thickness distribution that provides robustness for encountering foreign objects while reducing a weight of the airfoil, and thus, the fan blade structure. Furthermore, other desirable features and characteristics of the present disclosure will become apparent from the subsequent detailed description and the appended claims, taken in conjunction with the accompanying drawings and the foregoing technical field and background.

SUMMARY

According to various embodiments, a fan blade for a gas turbine engine is provided. The fan blade includes an airfoil extending from a root to a tip in a spanwise direction and having a leading edge and a trailing edge in a chordwise direction. The airfoil has a span that extends from the root to the tip and a first chord line that extends from the leading edge to the trailing edge. The first chord line is at 0% at the leading edge and is at 100% at the trailing edge. The airfoil has a first local maximum thickness defined between about 85% of the span to the tip, a second local maximum thickness defined between about 40% to about 85% of the span and a third local maximum thickness defined between the root to about 40% of the span. The second local maximum thickness is positioned at about 10% to about 30% of the first chord line so as to be offset from the first local maximum thickness in the chordwise direction toward the leading edge. Each of the first local maximum thickness, the second local maximum thickness and the third local maximum thickness are different.

Further provided is a fan blade for a gas turbine engine. The fan blade includes an airfoil extending from a root to a tip in a spanwise direction and having a leading edge and a trailing edge in a chordwise direction. The airfoil has a span that extends from the root to the tip, and a first chord line and a second chord line that each extend from the leading edge to the trailing edge. The first chord line and the second chord line are at 0% at the leading edge and at 100% at the trailing edge. The airfoil has a first local maximum thickness defined between about 85% of the span to the tip, a second local maximum thickness defined between about 40% to about 85% of the span and a third local maximum thickness defined between the root to about 40% of the span. The second local maximum thickness is positioned at about 10% to about 30% of the first chord line and the first local maximum thickness is positioned at about 40% to about 60% of the second chord line such that the second local maximum thickness is offset from the first local maximum thickness in the chordwise direction toward the leading edge. The first local maximum thickness is less than the second local maximum thickness.

Also provided is a gas turbine engine. The gas turbine engine includes a blade having an airfoil extending from a root to a tip in a spanwise direction and having a leading edge and a trailing edge in a chordwise direction. The airfoil has a span that extends from the root to the tip, and a first chord line and a second chord line that each extend from the leading edge to the trailing edge. The first chord line and the second chord line are at 0% at the leading edge and at 100% at the trailing edge. The airfoil has a first local maximum thickness defined between about 85% of the span to the tip, a second local maximum thickness defined between about 40% to about 85% of the span and a third local maximum thickness defined between the root to about 40% of the span. The second local maximum thickness is positioned at about 10% to about 30% of the first chord line and the third local maximum thickness is positioned at about 40% to about 60% of the second chord line such that the second local maximum thickness is offset from the third local maximum thickness in the chordwise direction toward the leading edge. The second local maximum thickness is less than the third local maximum thickness. The blade including a platform coupled to the airfoil and adapted to couple the blade to a rotor associated with the gas turbine engine.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description. In addition, those skilled in the art will appreciate that embodiments of the present disclosure may be practiced in conjunction with any type of component that would benefit from having a maximum thickness distribution, and that the airfoil of a fan blade structure described herein for use with a gas turbine engine is merely one exemplary embodiment according to the present disclosure. Moreover, while the airfoil is described herein as being used with a fan blade structure of a gas turbine engine onboard a mobile platform or vehicle, such as a bus, motorcycle, train, motor vehicle, marine vessel, aircraft, rotorcraft and the like, the various teachings of the present disclosure can be used with a gas turbine engine or with a fan blade structure associated with a stationary platform. Further, it should be noted that many alternative or additional functional relationships or physical connections may be present in an embodiment of the present disclosure. In addition, while the figures shown herein depict an example with certain arrangements of elements, additional intervening elements, devices, features, or components may be present in an actual embodiment. It should also be understood that the drawings are merely illustrative and may not be drawn to scale.

Figure 1:
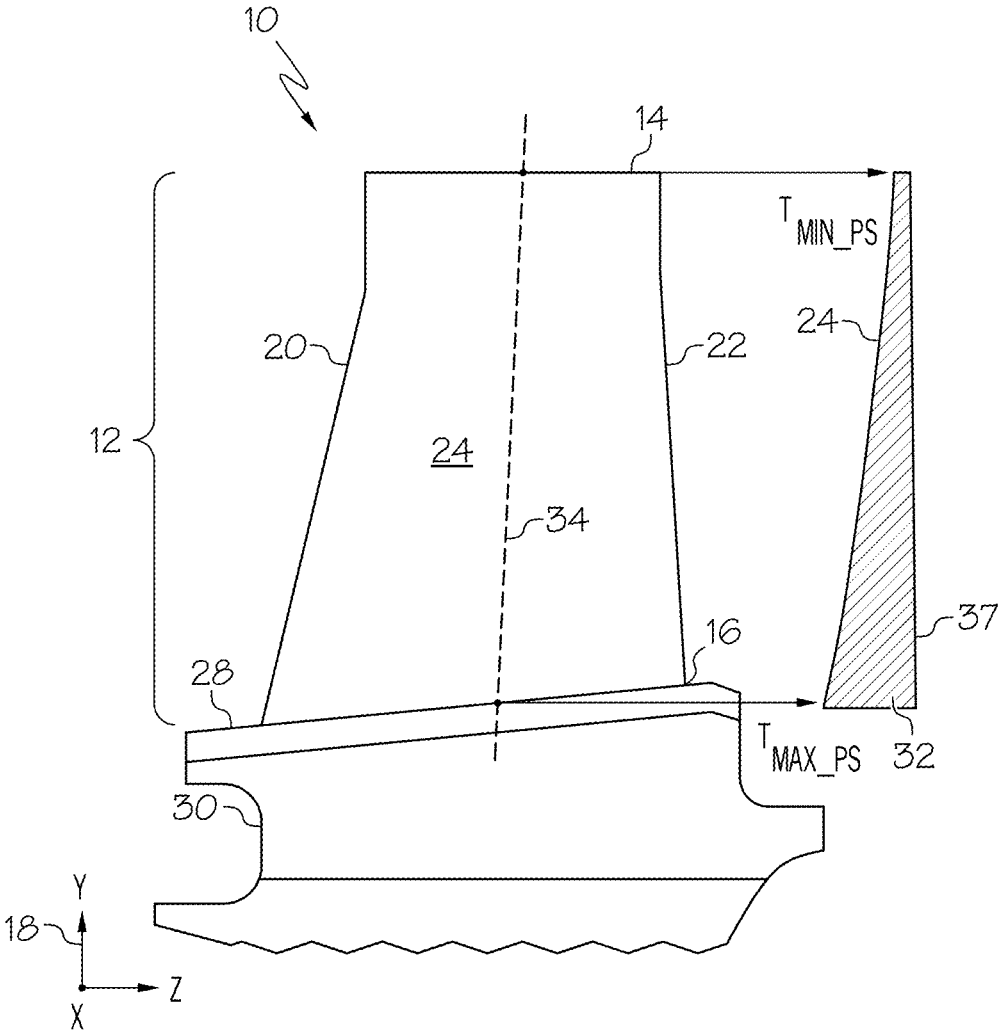
FIG. 1 (PRIOR ART)
FIGS. 1 and 2 are opposing side views of a Gas Turbine Engine (GTE) airfoil structure (here, a rotor blade structure) having monotonic thickness distributions in chordwise and spanwise directions, as shown in conjunction with associated cross-sectional views through the airfoil thickness and illustrated in accordance with the teachings of prior art.
Figure 2:
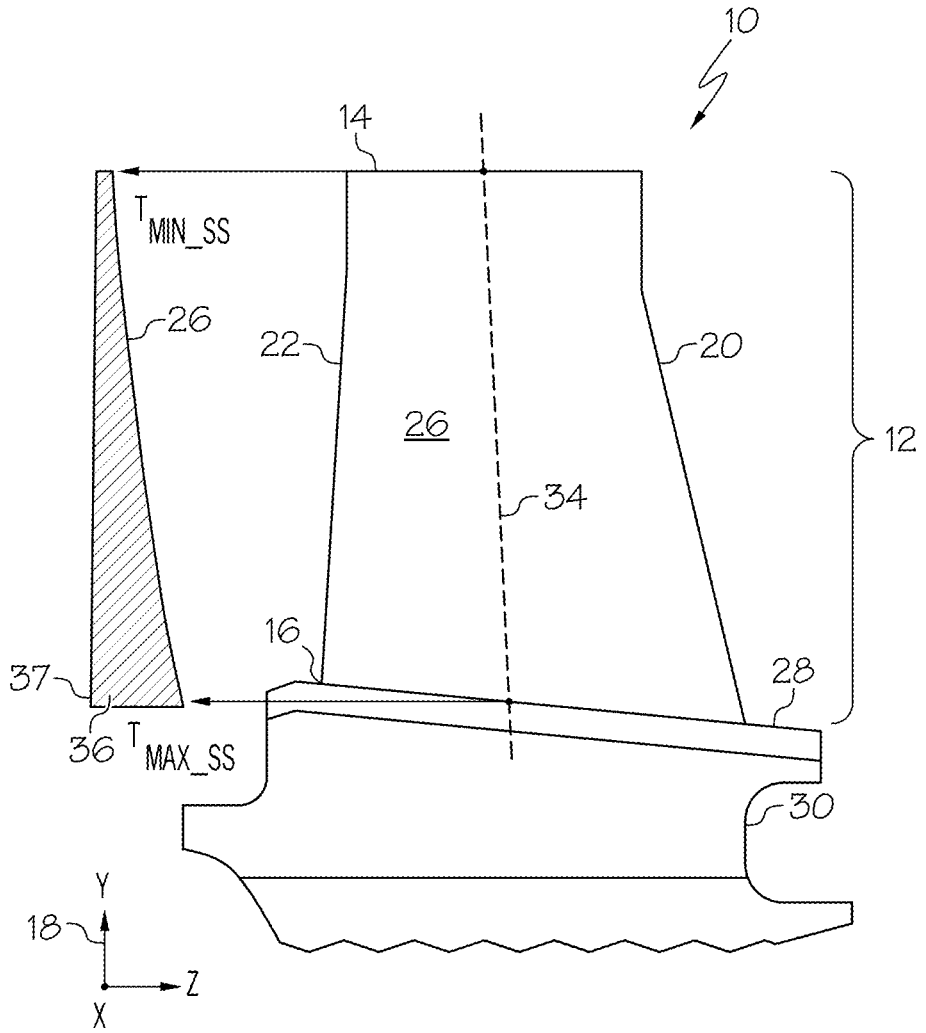
FIG. 2 (PRIOR ART)

Gas turbine engine (GTE) airfoils are conventionally imparted with monotonic thickness distributions in both spanwise and chordwise directions. With respect to the airfoil thickness distribution in the spanwise direction, in particular, a GTE airfoil may taper monotonically from a global maximum thickness located at the airfoil base or root to a global minimum thickness located at the airfoil tip. Further illustrating this point, FIGS. 1 and 2 depict a conventional GTE airfoil structure 10 including an airfoil portion 12, which is shown in a meridional or flattened state. In this example, the GTE airfoil structure 10 is a rotor blade piece and the airfoil portion 12 is a rotor blade; consequently, the GTE airfoil structure 10 and the airfoil portion 12 are referred to hereafter as "rotor blade structure 10" and "rotor blade 12," respectively. As can be seen, the rotor blade 12 includes a blade tip 14 and a blade root 16, which are spaced in a blade height or spanwise direction. The spanwise direction generally corresponds to the Y-axis identified by a coordinate legend 18 appearing in the lower left corner of FIGS. 1 and 2.

The rotor blade 12 further includes a leading edge 20, a trailing edge 22, a first principal face or "pressure side" 24 (shown in FIG. 1), and a second principal face or "suction side" 26 (shown in FIG. 2). The pressure side 24 and the suction side 26 are opposed in a thickness direction, which generally corresponds to the X-axis of the coordinate legend 18 in the meridional views of FIGS. 1 and 2. The pressure and suction sides 24, 26 extend from the leading edge 20 to the trailing edge 22 in a chordwise direction, which generally corresponds to the Z-axis of the coordinate legend 18. In the illustrated example, the rotor blade structure 10 further includes a platform 28 and a shank 30, which is partially shown and joined to the platform 28 opposite the rotor blade 12. In certain embodiments, the rotor blade structure 10 may be a discrete, insert-type blade piece, and the shank 30 may be imparted with an interlocking shape for mating insertion into a corresponding slot provided in a separately-fabricated rotor hub (not shown). In other embodiments, the rotor blade structure 10 may assume various other forms such that the rotor blade 12 is integrally formed with or otherwise joined to a rotor hub as, for example, a blisk. The rotor blade 12 may or may not be cambered and/or symmetrical.

The rotor blade 12 may be conceptually divided into a pressure side blade half and an opposing suction side blade half, which are joined along an interface represented by vertical lines 37 in the below-described cross-sectional views of FIGS. 1 and 2. When the rotor blade 12 is cambered, the interface between the blade halves may generally correspond to the camber line of the rotor blade 12, as extended through the rotor blade 12 from the blade tip 14 to the blade root 16 to define the blade halves. FIG. 1 further depicts a cross-sectional view of the pressure side blade half (identified by reference numeral "32"), as taken along a cross-section plane extending in thickness and spanwise directions (represented by dashed line 34 and generally corresponding to an X-Y plane through the meridional view of the rotor blade 12). Similarly, FIG. 2 sets-forth a cross-sectional view of the suction side blade half (identified by reference numeral "36"), as further taken along the cross-section plane 34. The cross-section plane 34 extends through a middle portion of the rotor blade 12 generally centered between the leading edge 20 and the trailing edge 22. The cross-sectional views shown in FIGS. 1 and 2 are not drawn to scale with certain dimensions exaggerated to more clearly illustrate variations in blade thickness.

Referring initially to the cross-section of FIG. 1, the pressure side blade half 32 has a monotonic spanwise thickness distribution; that is, a thickness distribution lacking multiple interspersed local minima and maxima, as considered in the spanwise direction. As indicated on the right side of FIG. 1, the thickness of the pressure side blade half 32 gradually decreases from a global maximum thickness located at the blade root 16 (identified as "$T_{MAX_PS}$") to a global minimum thickness located at the blade tip 14 (identified as "$T_{MIN_PS}$"), both thicknesses taken in the cross-section plane 34. The spanwise thickness distribution of the suction side blade half 36 is also monotonic and may mirror the spanwise thickness distribution of the pressure side blade half 32. Accordingly, and as can be seen in the cross-section appearing on the left side of FIG. 2, the suction side blade half 36 has a monotonic spanwise thickness distribution, which decreases from a global maximum thickness at the blade root 16 (identified as "$T_{MAX_SS}$") in the cross-section plane 34 to a global minimum thickness at the blade tip 14 (identified as "$T_{MIN_SS}$"). The blade halves 32, 36 are thus each produced to have a monotonic thickness distribution in a spanwise direction, as taken along the cross-section plane 34. The blade halves 32, 36 also have monotonic spanwise thickness distributions taken along other, non-illustrated cross-section planes extending parallel to the cross-section plane 34, although the monotonic spanwise thickness distributions of the blade halves 32, 36 taken along other planes may vary in relative dimensions. In a similar regard, the blade halves 32, 36 (and, more generally, the rotor blade 12) may also be imparted with thicknesses distribution in chordwise directions that are not multimodal, or a thickness distribution lacking multiple interspersed local minima and maxima, as considered in the chordwise direction. For example, the blade halves 32, 36 may each have a maximum global thickness, which is located near, but offset from the leading edge 20; and which decreases monotonically when moving in a chordwise direction toward either the leading edge 20 or the trailing edge 22.

Several benefits may be achieved by imparting a GTE airfoil, such as the rotor blade 12, with relatively non-complex, monotonic thickness distributions in the chordwise and spanwise directions. Generally, GTE airfoils having monotonic thickness distributions provide high levels of aerodynamic performance, are relatively straightforward to model and design, and are amenable to production utilizing legacy fabrication processes, such as flank milling. These advantages notwithstanding, the present inventors have recognized that certain benefits may be obtained by imparting GTE airfoils with non-monotonic thickness distributions and, specifically, with multimodal thickness distributions in at least spanwise directions. Traditionally, such a departure from monotonic airfoil designs may have been discouraged by concerns regarding excessive aerodynamic penalties and other complicating factors, such as manufacturing and design constraints. The present inventors have determined, however, that GTE airfoils having such multimodal thickness distributions (e.g., in the form of strategically positioned and shaped regions of locally-increased and locally-decreased thicknesses) may obtain certain notable benefits from mechanical performance and weight savings perspectives, while incurring little to no degradation in aerodynamic performance of the resulting airfoil.

Benefits that may be realized by imparting GTE airfoils with tailored multimodal thickness distributions may include, but are not limited to: (i) shifting of the vibrational response of the airfoil to excitation modes residing outside of the operational frequency range of a particular GTE or at least offset from the primary operational frequency bands of the GTE containing the GTE airfoil, (ii) decreased stress concentrations within localized regions of the airfoil during GTE operation, and/or (iii) increased structural robustness in the presence of high impact forces, as may be particularly beneficial when the airfoil assumes the form of a turbofan blade, a propeller blade, or a rotor blade of an early stage axial compressor susceptible to bird strike. As a still further advantage, imparting a GTE airfoil with such a tailored multimodal thickness distribution can enable the GTE airfoil to satisfy performance criteria at a reduced volume and weight. While it may be possible to boost fracture resistance in the event of high force impact by increasing the mean global thickness of a GTE airfoil having a monotonic thickness distribution, doing so inexorably results in an increase in the overall weight of the individual airfoil. Such a weight penalty may be significant when considered cumulatively in the context of a GTE component containing a relatively large number of airfoils. In contrast, the strategic localized thickening of targeted airfoil regions to boost high impact force fracture resistance (and/or other mechanical attributes of the airfoil), and/or the strategic localized thinning of airfoil regions having a lesser impact on the mechanical properties of the airfoil, may produce a lightweight GTE airfoil having enhanced mechanical properties, while also providing aerodynamic performance levels comparable to those of conventional monotonic GTE airfoils.

Figure 3:
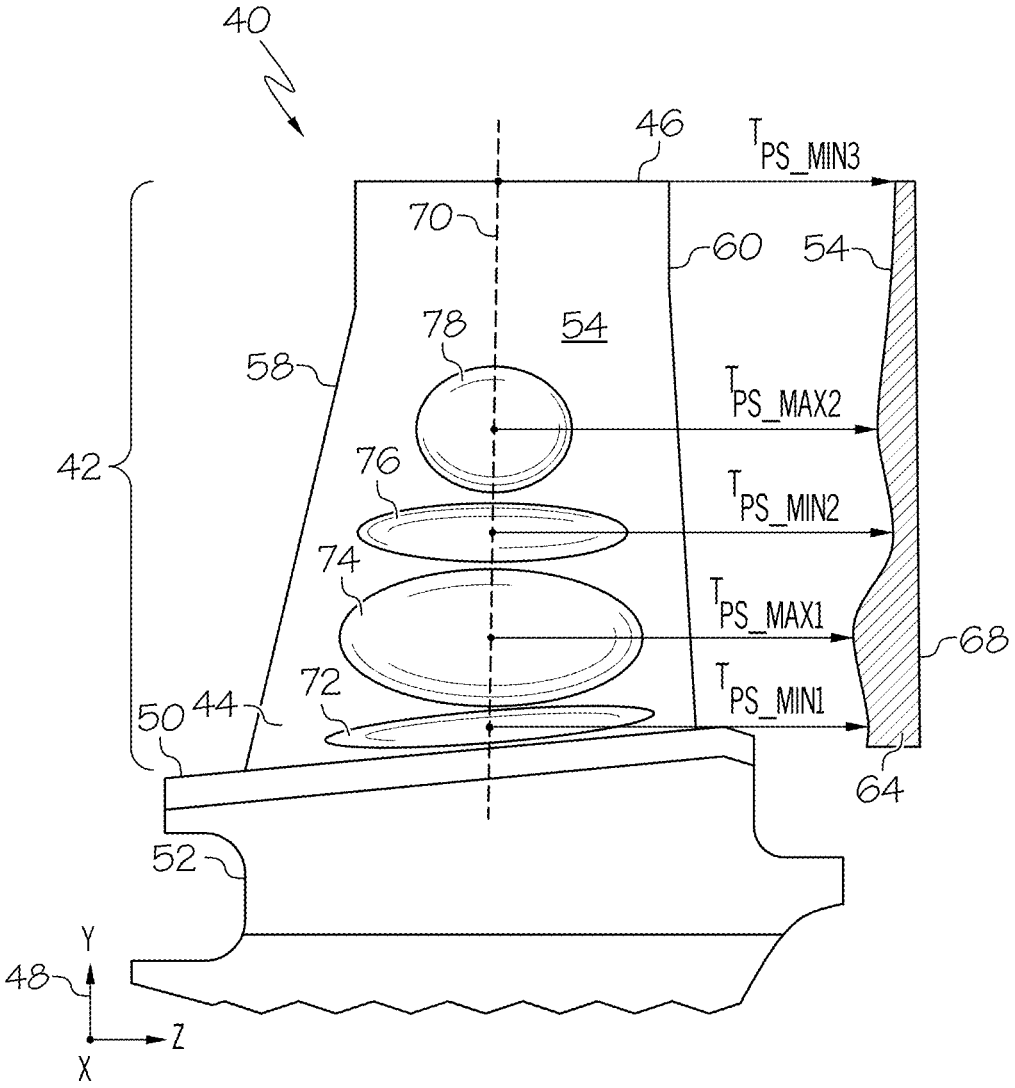
FIGS. 3 and 4 are opposing side views of a GTE airfoil structure having a multimodal thickness distribution in at least an airfoil height or spanwise direction, as shown in conjunction with associated cross-sectional views through the airfoil thickness and illustrated in accordance with an exemplary embodiment of the present disclosure.
Figure 4:
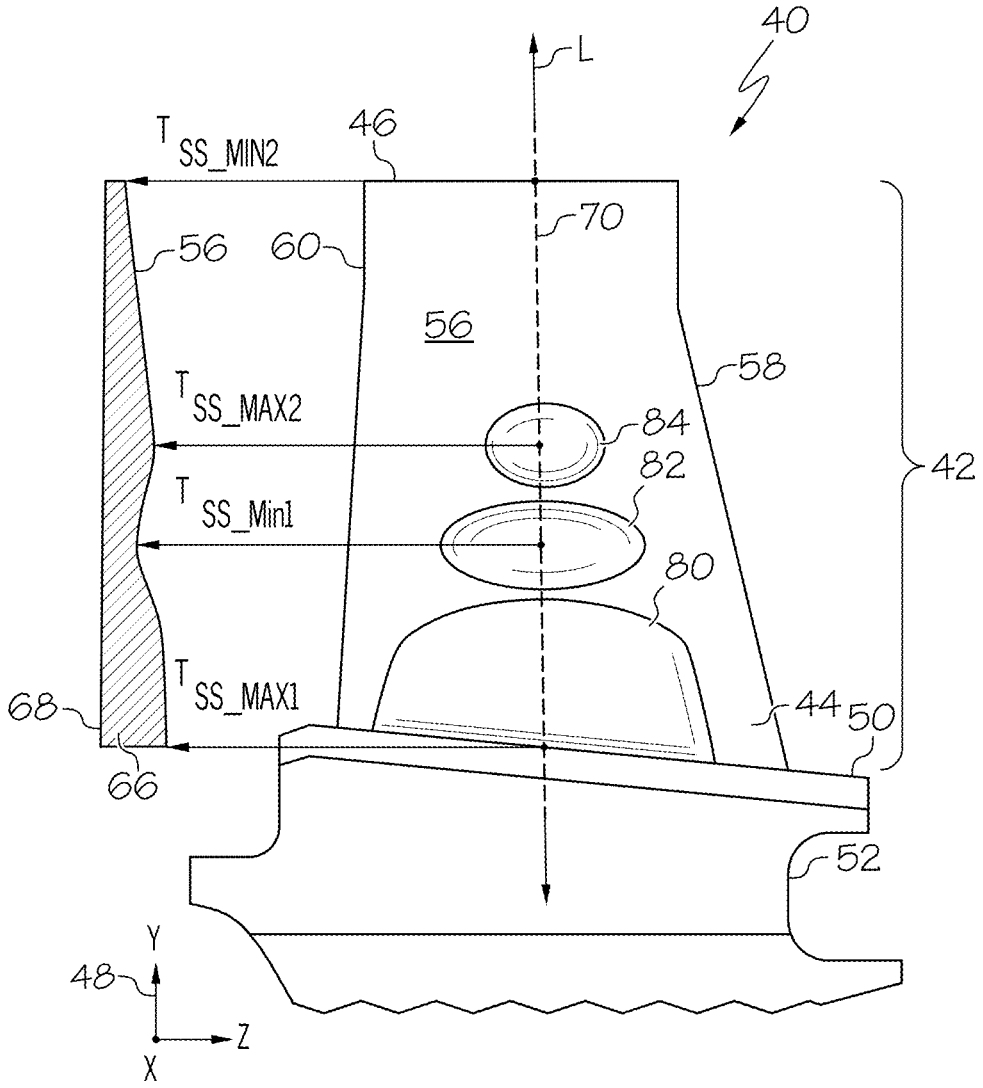
Figure 5:
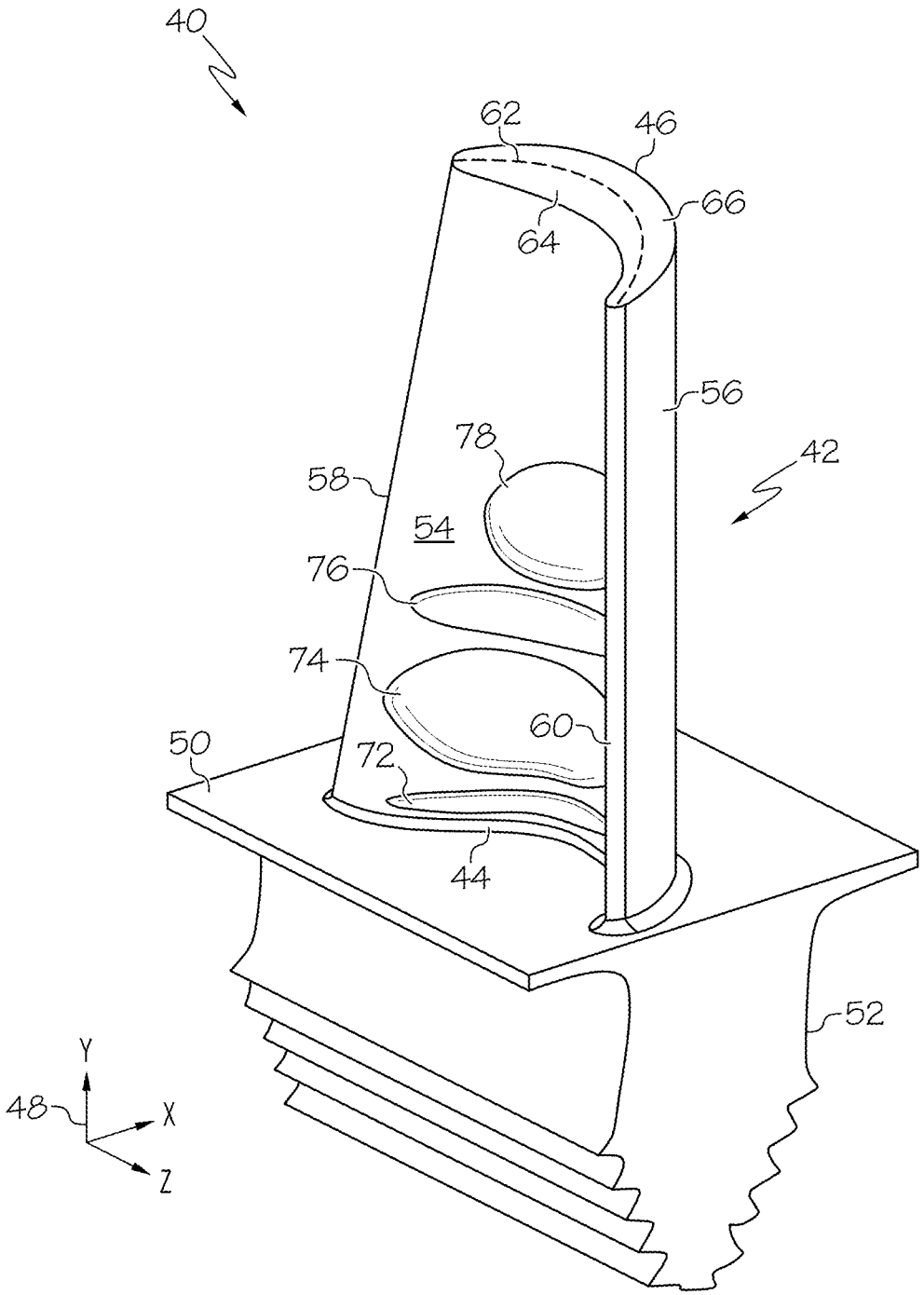
FIG. 5 is an isometric view of the exemplary GTE airfoil shown in FIGS. 3 and 4.

Turning now to FIGS. 3-5, there is shown a GTE airfoil structure 40 including a GTE airfoil 42, as illustrated in accordance with an exemplary embodiment of the present disclosure. In certain respects, the GTE airfoil structure 40 is similar to the conventional GTE airfoil structure 10 discussed above in conjunction with FIGS. 1 and 2. For example, as was previously the case, the GTE airfoil structure 40 assumes the form of a rotor blade structure and will consequently be referred to as "rotor blade structure 40" hereafter, while the GTE airfoil 42 is referred to as "rotor blade 42." The instant example notwithstanding, it is emphasized that the following description is equally applicable to other types of GTE airfoils, without limitation, including other types of rotor blades included in axial compressors, impellers, axial turbines, or radial turbines; turbofans blades; propeller blades; and static GTE vanes, such as turbine nozzle vanes and inlet guide vanes.

The rotor blade 42 includes a blade root 44 and an opposing blade tip 46. The blade tip 46 is spaced from the blade root 44 in a blade height or spanwise direction, which generally corresponds to the Y-axis of the coordinate legend 48 in the meridional views of FIGS. 3 and 4, as well as in the isometric view of FIG. 5. The blade root 44 is joined (e.g., integrally formed with) a platform 50 further included in the rotor blade structure 40. The rotor blade 42 thus extends from the platform 50 in the spanwise direction and terminates in the blade tip 46. Opposite the rotor blade 42, the platform 50 is joined to (e.g., integrally formed with) a base portion or shank 52 of the rotor blade structure 40. The rotor blade 42 further includes a first principal face or "pressure side" 54 and a second, opposing face or "suction side 56." The pressure side 54 and the suction side 56 extend in a chordwise direction and are opposed in a thickness direction (generally corresponding to the Z- and X-axes of the coordinate legend 48, respectively, in the meridional views of FIGS. 3 and 4). The pressure side 54 and the suction side 56 extend from a leading edge 58 to a trailing edge 60 of the rotor blade 42. In the illustrated example, the rotor blade 42 is somewhat asymmetrical along a longitudinal axis defined through a midpoint of the rotor blade 42 (and cambered, as shown most clearly in FIG. 5 (noting dashed camber line 62 extending along blade tip 46). The pressure side 54 thus has a contoured, generally concave surface geometry, which gently bends or curves in three dimensions. Conversely, the suction side 56 has a countered, generally convex surface geometry, which likewise bends or curves in multiple dimensions. In further embodiments, the rotor blade 42 may not be cambered and may be either symmetrical or asymmetrical.

As shown most clearly in FIG. 5, the shank 52 may be produced to have an interlocking geometry, such as a fir tree or dovetail geometry. When the rotor blade structure 40 is assembled into a larger rotor, the shank 52 is inserted into mating slots provided around an outer circumferential portion of a separately-fabricated hub disk to prevent disengagement of the rotor blade structure 40 during high speed rotation of the rotor. In other implementations, the rotor blade structure 40 may be joined (e.g., via brazing, diffusion bonding, or the like) to a plurality of other blade structures to yield a blade ring, which is then bonded to a separately-fabricated hub disk utilizing, for example, a Hot Isostatic Pressing (HIP) process. As a still further possibility, a rotor can be produced to include a number of blades similar to the rotor blade 42, but integrally produced with the rotor hub as a single (e.g., forged and machined) component or blisk. Generally, then, it should be understood that the rotor blade structure 40 is provided by way of non-limiting example and that the rotor blade structure 40 (and the other airfoil structures described herein) can be fabricated utilizing various different manufacturing approaches. Such approaches may include, but are not limited to, casting and machining, three dimensional metal printing processes, direct metal laser sintering, Computer Numerical Control (CNC) milling of a preform or blank, and powder metallurgy, to list but a few examples.

As was previously the case, the rotor blade 42 can be conceptually divided into two opposing halves: i.e., a pressure side blade half 64 and a suction side blade half 66. The pressure side blade half 64 and the suction side blade half 66 are opposed in a thickness direction (again, corresponding to the X-axis of the coordinate legend 48 for the meridional views of FIGS. 3 and 4). The blade halves 64, 66 may be integrally formed as a single part or monolithic piece such that the division or interface between the blade halves 64, 66 is a conceptual boundary, rather than a discrete physical boundary; however, the possibility that the blade halves 64, 66 may be separately fabricated (e.g., cast) and then joined in some manner is by no means precluded. Additionally, it should be appreciated that the boundary or interface between the blade halves 64, 66 need not precisely bisect the rotor blade 42. Accordingly, the term "half," as appearing in this document, is utilized in a generalized sense to indicate that the rotor blade 42 can be divided in two portions along an interface generally extending in the spanwise and chordwise directions. In an embodiment, the blade halves 64, 66 may have approximately equivalent volumes; that is, volumes that different by no more than 10%. In the illustrated example, the pressure side blade half 64 may generally correspond to the portion of the rotor blade 42 bounded by the pressure side 54 and the camber line 62 (FIG. 5), as extended through the rotor blade 42 from the blade root 44 to the blade tip 46. Conversely, the suction side blade half 66 may generally correspond to the portion of the rotor blade 42 bounded by the suction side 56 and the camber line 62, as extended through the rotor blade 42 from the blade root 44 to the blade tip 46.

FIGS. 3 and 4 further provide cross-sectional views of the pressure side blade half 64 and the suction side blade halve 66, respectively, as taken along a cross-section plane extending in thickness and spanwise directions (represented by dashed line 70 and generally corresponding to an X-Y plane in the illustrated meridional views). As described below, cross-section plane 70 extends through a middle or intermediate portion of the rotor blade 42 generally centered between the leading edge 58 and the trailing edge 60 of the rotor blade 42. For example, in an embodiment, the cross-section plane 70 may transect a midpoint located substantially equidistantly between the leading edge 58 and the trailing edge 60, as taken along either the blade tip 46 or along the blade root 44. Description will now be provided regarding various thicknesses of the pressure side blade half 64 and the suction side blade half 66. For the purposes of this document, when referring to the thicknesses of a blade (or airfoil) half, the blade (or airfoil) thicknesses are measured from the interface or boundary between blade (or airfoil) halves to the outer principal surface of the corresponding blade (or airfoil) half. As an example, in the case of the pressure side blade half 64, blade thicknesses are measured from the boundary between the blade halves 64, 66 (corresponding to vertical line 68 in the cross-sections of FIGS. 3 and 4) to the suction side 54. The cross-sectional views of FIGS. 3 and 4 are not drawn to scale, and the differences between the below-described local thickness maxima and minima may be exaggerated for illustrative clarity.

Referring to the cross-section of FIG. 3, the pressure side blade half 64 is imparted with a multimodal spanwise thickness distribution; the term "multimodal spanwise thickness distribution" referring to a thickness distribution including multiple interspersed local minima and maxima, as taken in a spanwise direction. In this example, the pressure side blade half 64 has a multimodal spanwise thickness distribution including two local thickness maxima (identified as "$T_{PS_MAX1}$" and "$T_{PS_MAX2}$") interspersed with three local thickness minima (identified as "$T_{PS_MIN1}$," "$T_{PS_MIN2}$," and "$T_{PS_MIN3}$"). As taken within the cross-section plane 70, and moving from the blade root 44 outwardly toward the blade tip 46, the thickness of the pressure side blade half 64 initially increases from a first local thickness minimum located at or adjacent the blade root 44 ($T_{PS_MIN1}$) to a first local thickness maximum ($T_{PS_MAX1}$) located slightly outboard (that is, toward the blade tip 46) of $T_{PS_MIN1}$. In one embodiment, $T_{PS_MAX1}$ may be located between approximately a 10% to 30% span of the rotor blade 42, as measured in the spanwise direction and increasing in percentage with increasing proximity to the blade tip 46. Moving further toward the blade tip 46, the thickness of the pressure side blade half 64 then decreases from $T_{PS_MAX1}$ to a second local thickness minimum ($T_{PS_MIN2}$) located approximately between a 30% to 50% span of the rotor blade 42. Next, the thickness of the pressure side blade half 64 again increases from $T_{PS_MIN2}$ to a second local thickness maximum ($T_{PS_MAX2}$) located approximately between a 50% to 70% span of the rotor blade 42. Finally, the thickness of the pressure side blade half 64 again decreases from $T_{PS_MAX2}$ to a third local thickness minimum ($T_{PS_MIN3}$) located at the blade tip 46 (100% span).

The pressure side blade half 64 further has a global mean or average thickness ($T_{PS_GLOBAL_AVG}$), as taken across the entirety of the blade half 64 in the thickness direction (again, corresponding to the X-axis of coordinate legend 48 for the meridional views of FIGS. 3 and 4). The relative dimensions of $T_{PS_GLOBAL_AVG}$, the local thickness maxima taken in the cross-section plane 70 ($T_{PS_MAX1\text{-}2}$) and elsewhere across the pressure side blade half 64, and the local thickness minima taken in the cross-section plane 70 ($T_{PS_MIN1\text{-}3}$) and elsewhere across the blade half 64 will vary amongst embodiments and may be tailored to best suit a particular application by, for example, fine tuning targeted mechanical properties of the rotor blade structure 40 in the below-described manner. To provide a useful, but non-limiting example, $T_{PS_MAX1}$ may be greater than $T_{PS_MAX2}$, which may, in turn, be greater than $T_{PS_GLOBAL_AVG}$ in an embodiment. Additionally, $T_{PS_MIN1}$ may be greater than $T_{PS_MIN2}$, which may, in turn, be greater than $T_{PS_MIN3}$. In other embodiments, $T_{PS_MIN2}$ and $T_{PS_MIN3}$ may both be less than $T_{PS_GLOBAL_AVG}$, while $T_{PS_MIN1}$ may or may not be less than $T_{PS_GLOBAL_AVG}$. In further implementations, $T_{PS_MAX1}$ may be at least twice the minimum local thickness at the blade tip 46 ($T_{PS_MAX1}$). The thickness profile of the rotor blade 42 may vary taken along other section planes parallel to the cross-section plane 70, as considered for the meridional views of the rotor blade 42. For example, taken along a cross-section plane adjacent plane 70, the rotor blade 42 may have a similar multimodal thickness distribution, but with a lesser disparity in magnitude between $T_{PS_MAX1\text{-}2}$ and $T_{PS_MIN1\text{-}3}$. Furthermore, in certain embodiments, the rotor blade 42 may have a monotonic thickness distribution taken along certain other cross-section planes, such as cross-sectional planes extending in spanwise and thickness directions and located at or adjacent the leading edge 58 or the trailing edge 60.

The above-described multimodal thickness distribution of the pressure side blade half 64 may be defined by multiple locally-thickened and locally-thinned regions of the rotor blade 42. These regions are generically represented in the meridional view of FIG. 3 by ovular symbols or graphics. In one example, a first ovular graphic 72 represents a substantially concave, locally-thinned region of the pressure side blade half 64, which generally centers around $T_{PS_MIN1}$ as its nadir. Similarly, a second ovular graphic 74 represents a substantially convex, locally-thickened region of the pressure side blade half 64, which generally centers around in $T_{PS_MAX1}$ at its apex. A third ovular graphic 76 represents a substantially concave, locally-thinned region of the blade half 64, which centers around $T_{PS_MIN2}$ as its nadir. Finally, a fourth ovular graphic 78 represents a generally convex, locally-thickened region of the pressure side blade half 64, which culminates in $T_{PS_MAX2}$ at or near its centerpoint. Regions 72, 76 may thus be regarded as contoured valleys or depressions formed in the suction side 54, while regions 74, 78 may be regarded as rounded peaks or hills. Regions 72, 74, 76, 78 are considered "locally-thinned" or "locally-thickened," as the case may be, relative to the respective thicknesses these regions would otherwise have if the pressure side blade half 42 were imparted with a monotonic thickness distribution having maximum and minimum thicknesses equivalent to those of the blade half 42. The transitions between the locally-thickened and locally-thinned regions 72, 74, 76, 78 are characterized by relatively gradual, smooth, non-stepped surface geometries for optimal aerodynamic efficiency; however, the possibility that one or more stepped regions may be included in the surface contours of the pressure side 54 in transition between regions 72, 74, 76, 78 is not precluded.

The selection of the particular regions of the pressure side blade half 64 to locally thicken, the selection of the particular regions to locally thin, and manner in which to shape and dimension such thickness-modified regions can be determined utilizing various different design approaches, which may incorporate any combination of physical model testing, computer modeling, and systematic analysis of in-field failure modes. Generally, an approach may be utilized where regions of the pressure side blade half 64 (or, more generally, the rotor blade 42) are identified as having a relatively pronounced or strong influence on one or more mechanical parameters of concern and are then targeted for local thickening. Additionally or alternatively, regions of the blade half 64 (or, more generally, the rotor blade 42) may be identified having a less impactful or relatively weak influence on the mechanical parameters of concern and targeted for local thickness reduction. In the case of the rotor blade 42, for example, it may be determined that the region 78 has a pronounced influence on the ability of the rotor blade 42 to withstand high force impact, such as bird strike, without fracture or other structural compromise. Region 78 may then be thickened by design to increase the mechanical strength of region 78 and, therefore, the overall ability of the rotor blade 42 to resist structural compromise due to high force impact. As a second example, region 74 may be identified as a region subject to high levels of localized stress when the rotor blade 42 operates in the GTE environment due to, for example, vibratory forces, centrifugal forces, localized heat concentrations, or the like. Thus, the thickness of region 74 may be increased to enhance the ability of region 74 to withstand such stress concentrations and/or to better distribute such mechanical stress over a broader volume of the rotor blade 42.

The regions of the pressure side blade half 64 identified as having a relatively low influence on the mechanical parameters of concern may be targeted for local thickness reduction. For example, and with continued reference to FIG. 3, regions 72, 76 may be identified as having relatively low stress concentrations and/or as relatively resistant to fracture in the event of high force impact. Material thickness may thus be removed from regions 72, 76 to reduce the overall volume and weight of the rotor blade 42 with little to no impact on the mechanical performance of the rotor blade 42. Material thickness also may be removed from regions 72, 76 and/or material thickness may be added to regions 74, 78 to shift the vibratory response of the rotor blade 42 to desirable frequencies and thereby further reduce mechanical stress within the rotor blade 42 when placed in the GTE operational environment. In this regard, regions 72, 74, 76, 78 may be locally-thinned or locally-thickened to shift the excitation or critical modes of the rotor blade 42 to bands outside of the operation range of the host GTE and/or to bands that are less frequently encountered during GTE operation. As a relatively simple example, if the rotor blade 42 (pre-thickness modification) were to experience significant resonance at a first frequency (e.g., 150 hertz) encountered at prolonged engine idle, the local thickening or thinning of the rotor blade 42 may shift the resonance of the rotor blade 42 to a second frequency (e.g., 170 hertz) that is only temporary encountered when the engine transitions from idle to cruise.

The suction side blade half 66 may have a second spanwise multimodal thickness distribution, which may or may not mirror the spanwise multimodal thickness distribution of the pressure side blade half 64. For example, the suction side blade half 66 may have a spanwise multimodal thickness distribution that is similar to, but not identical to the multimodal thickness distribution of the blade half 64; e.g., as indicated in FIG. 4, the suction side blade half 66 may have a spanwise multimodal thickness distribution including two local thickness maxima ($T_{SS_MAX1-2}$) interspersed with two local thickness minima ($T_{SS_MIN1-2}$), as taken in the cross-section plane 70. In this regard, and again moving outwardly from the blade root 44 toward the blade tip 46, the thickness of the pressure side blade half 64 may initially decrease from a first local thickness maximum ($T_{SS_MAX1}$) to a first local thickness minimum ($T_{SS_MIN1}$), then increase from $T_{SS_MIN1}$ to a second local thickness maximum ($T_{SS_MAX2}$), and finally decrease from $T_{SS_MAX2}$ to the second local thickness minimum ($T_{SS_MIN2}$). As was previously the case, $T_{SS_MAX1-2}$ and $T_{SS_MIN1-2}$ may be defined by multiple interspersed locally-thickened and locally-thinned blade regions. These regions are identified in FIG. 4 by symbols 80, 82, 84, with symbols 80, 84 representing localized convex regions or rounded hills formed in the suction side 56, and symbol 84 representing a localized concave region or valley in the suction side 56 between locally-thickened regions 82, 84. As previously indicated, the locations, shape, and dimensions of regions 80, 82, 84 may be selected as a function of impact on mechanical performance; e.g., to allow a designer to satisfy mechanical criteria, while minimizing the overall volume and weight of the rotor blade structure 40. In further embodiments, the suction side blade half 66 may instead have a non-multimodal spanwise thickness distribution, such as a monotonic thickness distribution or a flat surface geometry. In yet other embodiments, the suction side blade half 66 may have a multimodal spanwise thickness distribution, while the pressure side blade half 64 has a non-multimodal spanwise thickness distribution.

The foregoing has thus provided embodiments of a GTE airfoil having a multimodal thickness distribution in at least a spanwise direction. As described above, the GTE airfoil may have a spanwise multimodal thickness distribution as taken along a cross-section plane extending through an intermediate portion of the airfoil and, perhaps, transecting a midpoint along the airfoil tip and/or the airfoil root. The multimodal thickness distribution may be defined by multiple locally-thickened regions interspersed with (e.g., alternating with) multiple locally-thinned regions of the region through which the cross-section plane extends. In the above-described example, the locally-thickened regions and locally-thinned regions are imparted with substantially radially symmetrical geometries (with the exception of locally-thickened region 80) and are generally concentrically aligned in the spanwise direction as taken along cross-section plane 70. In further embodiments, the GTE airfoil may include locally-thickened regions and/or locally-thinned regions having different (e.g., irregular or non-symmetrical) geometries and which may or may not concentrically align in a spanwise direction. Furthermore, embodiments of the GTE airfoil may be imparted with a multimodal thickness distribution in a chordwise direction. Further emphasizing this point, an additional embodiment of a GTE airfoil having more complex multimodal thickness distributions in both spanwise and chordwise directions will now be described in conjunction with FIGS. 6 and 7.

Figure 6:
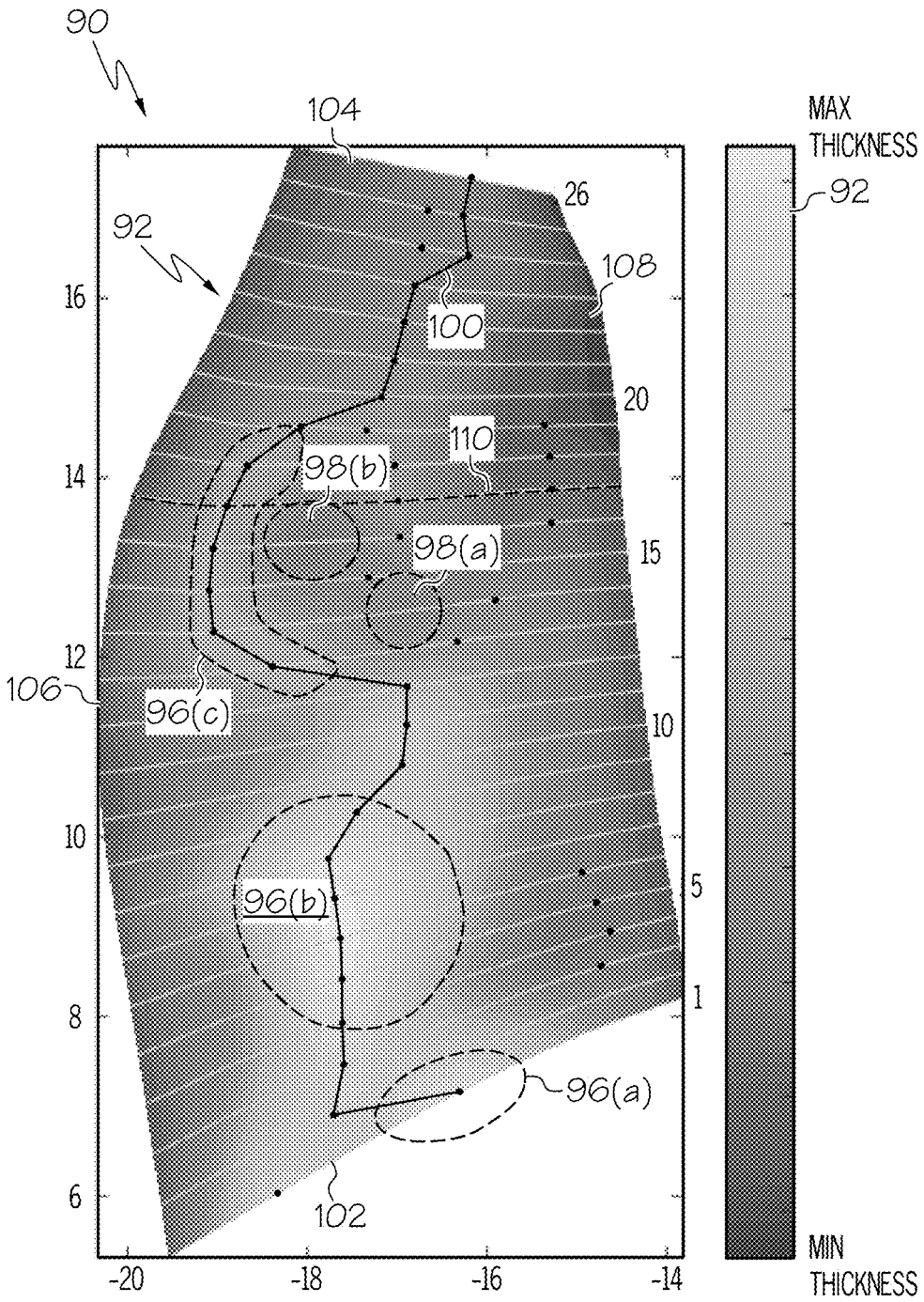
FIG. 6 is a meridional topographical view of a GTE airfoil including multimodal thickness distributions in spanwise and chordwise directions, as illustrated in accordance with an exemplary embodiment of the present disclosure.

FIG. 6 is a meridional topographical view of a GTE airfoil 90 including multimodal thickness distributions in both spanwise and chordwise directions, as illustrated in accordance with a further exemplary embodiment of the present disclosure. The GTE airfoil 90 can be, for example, a rotor blade, a turbofan blade, a propeller blade, a turbine nozzle vane, or an inlet guide vane. The illustrated thickness measurements are taken through a selected half 94 of the GTE airfoil 90, which may represent either the suction side or pressure side half of the airfoil 90. The opposing half of the GTE airfoil 90 may have a similar multimodal thickness distribution, a different multimodal thickness distribution, or a non-multimodal thickness distribution. As indicated by a thickness key 92 appearing on the right side of FIG. 6, the local thickness of GTE airfoil half 94 fluctuates between a maximum global thickness ($T_{MAX_GLOBAL}$) and a minimum global thickness ($T_{MIN_GLOBAL}$). The particular values of $T_{MAX_GLOBAL}$ and $T_{MIN_GLOBAL}$ will vary amongst embodiments. However, by way of non-limiting example, $T_{MAX_GLOBAL}$ may be between about 0.35 and about 0.75 inch, while $T_{MIN_GLOBAL}$ is between about 0.2 and about 0.01 inch in an embodiment. In further embodiments, $T_{MAX}$ and $T_{MIN}$ may be greater than or less than the aforementioned ranges.

With continued reference to FIG. 6, the GTE airfoil half 94 is imparted with a spanwise multimodal thickness distribution. In one example, the GTE airfoil half 94 includes a number of locally-thickened regions identified by graphics 96(*a*)-(*c*), as well as a number of locally-thinned regions identified by graphics 98(*a*)-(*b*). A line 100 is overlaid onto the principal surface of GTE airfoil half 94 and connects the maximum global thickness for each chord of the airfoil half 94 between the airfoil root 102 and the airfoil tip 104. Starting from the airfoil root 98 and moving outwardly toward the airfoil tip 100, chord-to-chord maximum global thickness line 100 initially moves toward the leading edge 106 when transitioning between locally-thickened regions 96(*a*), 96(*b*); recedes toward the trailing edge 108 when transitioning between locally-thickened regions 96(*b*), 96(*c*); then again advances toward the leading edge 106 within the crescent-shaped locally-thickened region 96(*c*); and finally again recedes toward the trailing edge 108 before reaching airfoil tip 104. The particular mechanical attributes enhanced by locally-thickened regions 96(*a*)-(*c*) may be interrelated such that each region 96(*a*)-(*c*) impacts multiple different mechanical parameters of the GTE airfoil 90. However, in a highly generalized sense, relatively large locally-thickened region 96(*b*) and/or locally-thickened region 96(*a*) may favorably increase the fracture resistance of the GTE airfoil half 94 when subject to bird strike or other high impact force; while locally-thickened region 96(*c*) may boost the ability of the GTE airfoil 90 to withstand high stress concentrations in approximately the 40% to 80% span of the GTE airfoil 90 (or may better dissipate such stress concentrations over a larger volume of material). Comparatively, locally-thinned regions 98(*a*)-(*b*) may help reduce the overall weight of the GTE airfoil 90, while providing no or a nominal material detriment to the mechanical properties of the GTE airfoil 90. Any combination of regions 96(*a*)-(*c*), 98(*a*)-(*b*) may also serve to shift the vibrational modes of the GTE airfoil 90 to preferred frequencies in the previously-described manner.

Figure 7:
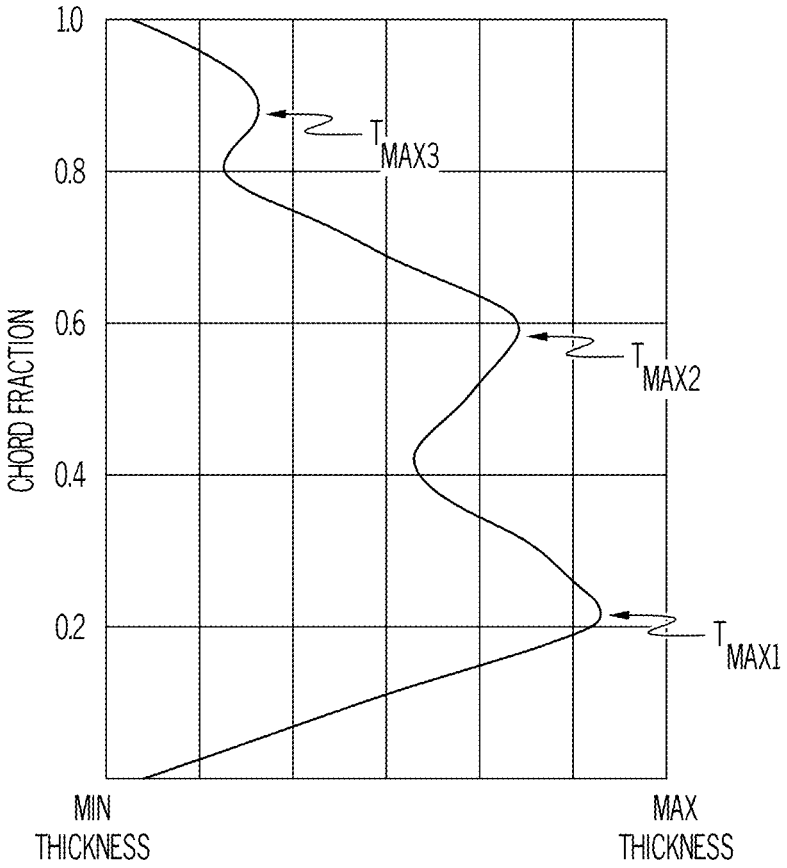
FIG. 7 is a graph of airfoil thickness (abscissa) versus chord fraction (ordinate) illustrating a spanwise multimodal thickness profile of the GTE airfoil shown in FIG. 6, as taken in a chordwise direction along a selected chord line (identified in FIG. 6) and including three local thickness maxima interspersed with multiple local thickness minima.

It should thus be appreciated that the GTE airfoil half 94 is imparted with a spanwise multimodal thickness distribution, as taken along a number of (but not all) cross-section planes extending in a spanwise direction and a thickness direction (into the plane of the page in FIG. 6). Concurrently, the GTE airfoil half 94 also has a multimodal thickness distribution in a chordwise direction, as taken along a number of (but not necessarily all) cross-section planes extending in chordwise and thickness directions. Consider, for example, the multimodal thickness distribution of the GTE airfoil half 94, as taken along chord line 110 identified in FIG. 6 and graphically expressed in FIG. 7. Referring jointly to FIGS. 6 and 7, it can be seen that the spanwise thickness distribution of the GTE airfoil half 94 along the chord line 110 contains three local thickness maxima (identified in FIG. 7 as "$T_{MAX1-3}$"), which are interspersed with at least two (here, four) local thickness minima. The lower edge of the graph in FIG. 7 corresponds to the leading edge 106 such that the maximum global thickness (in this example, $T_{MAX1}$) is located closer to the leading edge 106 than to the trailing edge 108. By imparting GTE airfoil half 94 with multimodal thickness distributions in both chordwise and spanwise directions in this manner, the airfoil designer is imparted with considerable flexibility to adjust the local thickness of the GTE airfoil half 94 (and possibly the opposing airfoil half) as a powerful tool in simultaneously enhancing multiple, often conflicting mechanical properties of the GTE airfoil 90 and/or in decreasing the volume and weight of the GTE airfoil 90, while maintaining relatively high levels of aerodynamic performance.

Multiple exemplary embodiment of GTE airfoils with tailored multimodal thickness distributions have thus been disclosed. In the foregoing embodiments, the GTE airfoils include multimodal thickness distributions in spanwise and/or in chordwise directions. The multimodal thickness distributions may be defined by regions of locally-increased thickness and/or locally-reduced thickness, which are formed across one or more principal surfaces (e.g., the suction side and/or the pressure side) of an airfoil. The number, disposition, shape, and dimensions of the regions of locally-increased thickness and/or locally-reduced thickness (and, thus, the relative disposition and disparity in magnitude between the local thickness maxima and minima) can be selected based on various different criteria including to reduce weight and to fine tune mechanical parameters; e.g., to boost high impact force fracture resistance, to better dissipate stress concentrations, to shift critical vibrational modes, and the like. Thus, in a general sense, the multimodal thickness distribution of the GTE airfoil can be tailored, by design, to selectively affect only or predominately those airfoil regions determined to have a relatively high influence on targeted mechanical properties thereby allowing an airfoil designer to satisfy mechanical goals, while minimize weight and aerodynamic performance penalties. While described above in conjunction with a particular type of GTE airfoil, namely, a rotor blade, it is emphasized that embodiments of the GTE airfoil can assume the form of any aerodynamically streamlined body or component included in a GTE and having an airfoil-shaped surface geometry, at least in predominate part, including both rotating blades and static vanes.

Figure 8:
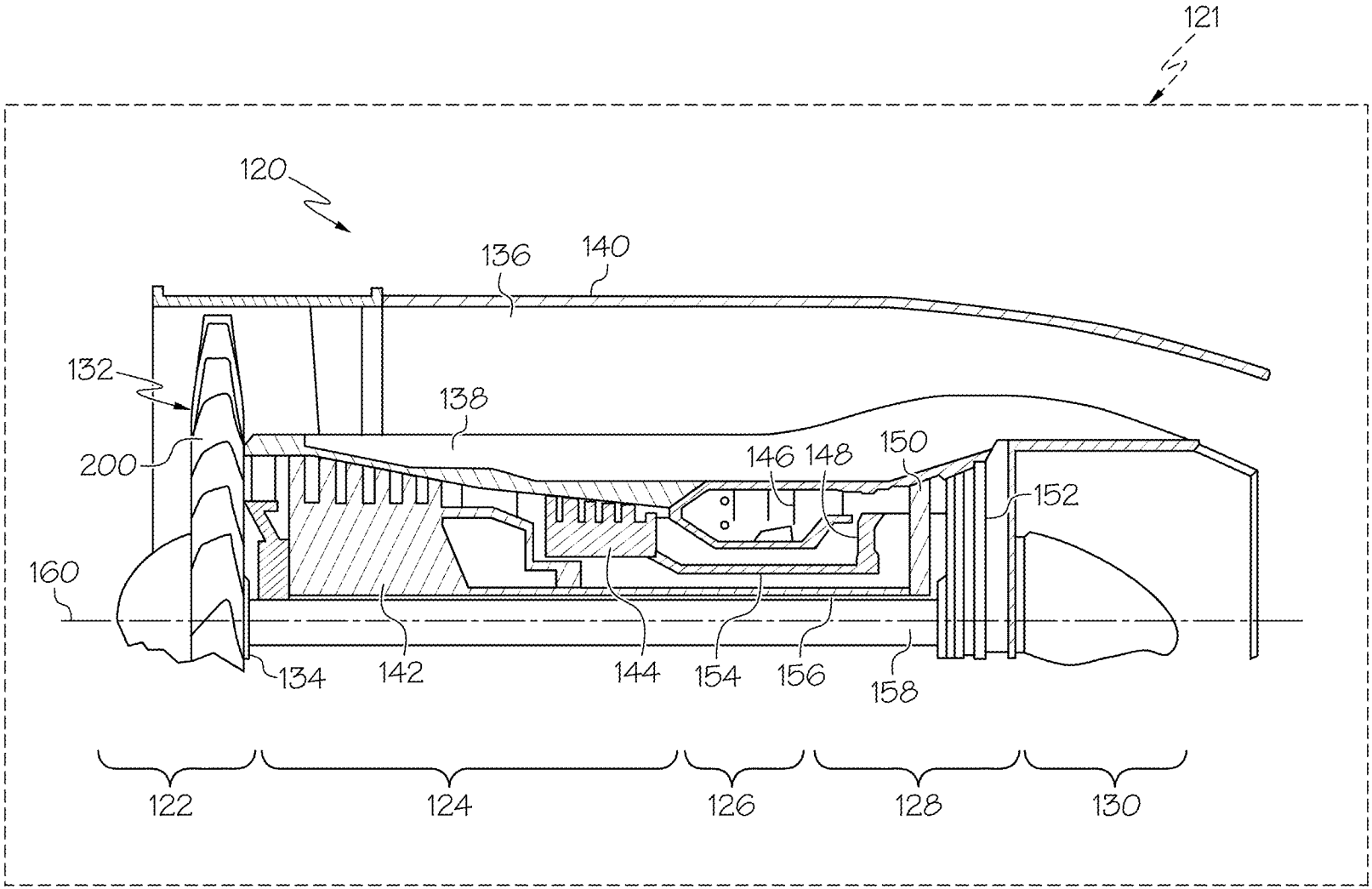
FIG. 8 is a schematic cross-sectional illustration of a gas turbine engine including a fan blade structure having an airfoil that has a maximum thickness distribution according to the various teachings of the present disclosure.

With reference to FIG. 8, a partial, cross-sectional view of an exemplary gas turbine engine 120 is shown with the remaining portion of the gas turbine engine 120 being axi-symmetric about a longitudinal axis 160, which also comprises an axis of rotation for the gas turbine engine 120. In the depicted embodiment, the gas turbine engine 120 is an annular multi-spool turbofan gas turbine jet engine 120 within an aircraft 121, although other arrangements and uses may be provided. Alternatively, the gas turbine engine 120 may be an auxiliary power unit ("APU"). As will be discussed herein, an airfoil of one or more fan blade structures 200 associated with the gas turbine engine 120 includes a maximum thickness distribution that provides robustness, while optimizing a weight of the fan blade structures 200. By providing the fan blade structures 200 with the maximum thickness distribution, the fan blade structures 200 may withstand one or more encounters with a foreign object, such as a bird strike, or a high impact force, and may have minimal deformation as a result of the encounter.

In this example, the gas turbine engine 120 includes a fan section 122, a compressor section 124, a combustor section 126, a turbine section 128 and an exhaust section 130. The fan section 122 includes a fan 132 mounted on a rotor 134 that draws air into the gas turbine engine 120 and accelerates it. The fan 132 includes a plurality of the fan blade structures 200. A fraction of the accelerated air exhausted from the fan 132 is directed through an outer (or first) bypass duct 136 and the remaining fraction of air exhausted from the fan 132 is directed into the compressor section 124. The outer bypass duct 136 is generally defined by an inner casing 138 and an outer casing 140. In the embodiment of FIG. 8, the compressor section 124 includes a low pressure compressor 142 and a high pressure compressor 144. However, in other embodiments, the number of compressors in the compressor section 124 may vary. In the depicted embodiment, the low pressure compressor 142 and the high pressure compressor 144 sequentially raise the pressure of the air and direct a majority of the high pressure air into the combustor section 126. A fraction of the compressed air bypasses the combustor section 126 and is used as a source of cooling fluid or air to cool other components.

In the embodiment of FIG. 8, in the combustor section 126, which includes a combustion chamber 146, the high pressure air is mixed with fuel and combusted. The high-temperature combusted air is then directed into the turbine section 128. In this example, the turbine section 128 includes three turbines disposed in axial flow series, namely, a high pressure turbine 148, a low pressure turbine 150, and a power turbine 152. However, it will be appreciated that the number of turbines, and/or the configurations thereof, may vary. In this embodiment, the high-temperature combusted air from the combustor section 126 expands through and rotates each turbine 148, 150, and 152. As the turbines 148, 150, and 152 rotate, each drives equipment in the gas turbine engine 120 via concentrically disposed shafts or spools. In one example, the high pressure turbine 148 drives the high pressure compressor 144 via a shaft 154, the low pressure turbine 150 drives the low pressure compressor 142 via a shaft 156, and the power turbine 152 drives the fan 132 via a shaft 158.

Figure 9:
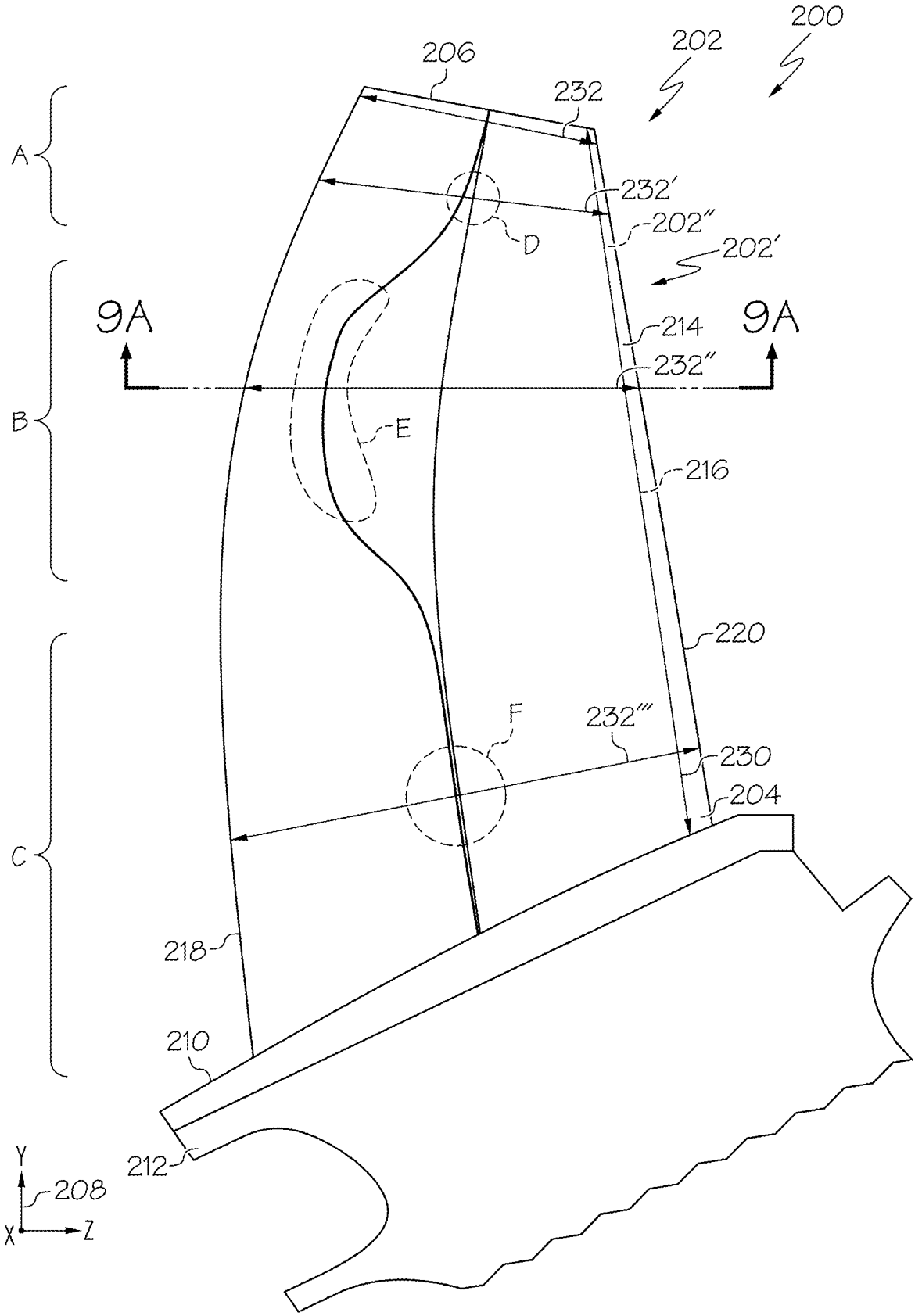
FIG. 9 is a meridional view of the airfoil of the fan blade structure of FIG. 8, which is coupled to a platform for coupling to a rotor of a fan associated with the gas turbine engine.
Figure 9A:
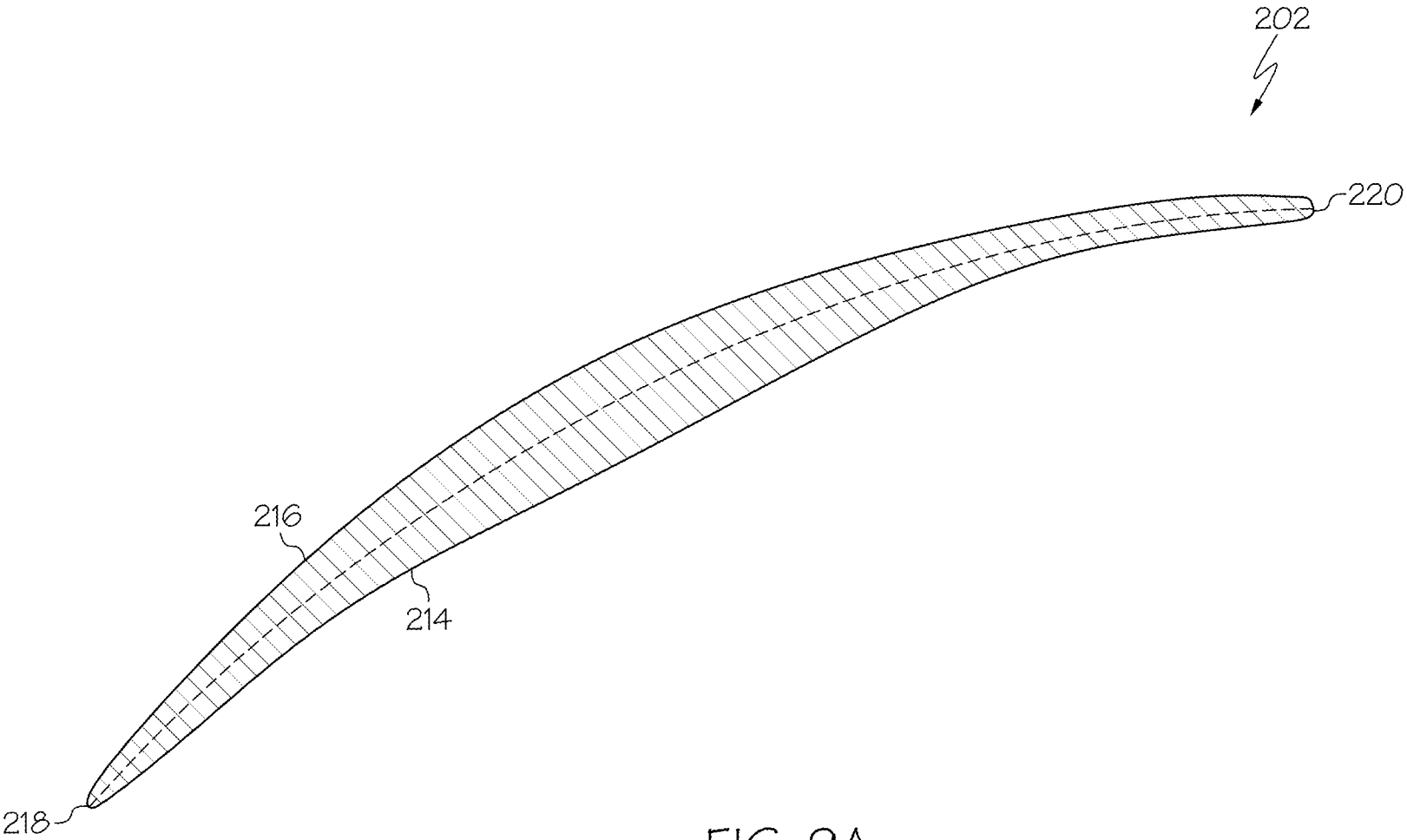
FIG. 9A is a cross-sectional view taken through the airfoil of the fan blade structure along line 9A-9A in FIG. 9.

With reference to FIG. 9, one of the fan blade structures 200 for use with the fan 132 of the gas turbine engine 120 is shown. In this example, the fan blade structure 200 includes a fan blade 202, which may be referred to as an "airfoil 202." The airfoil 202 includes an airfoil root 204 and an opposing airfoil tip 206. The airfoil tip 206 is spaced from airfoil root 204 in a blade height, span or spanwise direction, which generally corresponds to the Y-axis of a coordinate legend 208 in the meridional view of FIG. 9. The airfoil root 204 is joined (e.g., integrally formed with) a platform 210 further included in the fan blade structure 200. The airfoil 202 extends from the platform 210 in the spanwise direction and terminates in the airfoil tip 206. Opposite the airfoil 202, the platform 210 is joined to (e.g., integrally formed with) a base portion or shank 212 of the fan blade structure 200. The airfoil 202 further includes a first principal face or a "pressure side" 214 and a second, opposing face or a "suction side" 216. The pressure side 214 and the suction side 216 extend in a chordwise direction (Z-axis) and are opposed in a thickness direction (X-axis). The pressure side 214 and the suction side 216 extend from a leading edge 218 to a trailing edge 220 of the airfoil 202. In one example, the airfoil 202 is somewhat asymmetrical and cambered, as shown in FIG. 9A (the camber line of the airfoil 202 is represented by the dashed line that extends from the leading edge 218 to the trailing edge 220 in FIG. 9A). The pressure side 214 has a contoured, generally concave surface geometry, which gently bends or curves in three dimensions. The suction side 216 has a contoured, generally convex surface geometry, which likewise bends or curves in multiple dimensions. In further embodiments, the airfoil 202 may not be cambered and may be either symmetrical or asymmetrical.

With reference back to FIG. 9, the shank 212 may be produced to have an interlocking geometry, such as a fir tree or dovetail geometry. When the fan blade structure 200 is assembled into the rotor 134, the shank 212 is inserted into mating slots provided around an outer circumferential portion of a separately-fabricated hub disk to prevent disengagement of the fan blade structure 200 during high speed rotation of the rotor 134. In other embodiments, the fan blade structure 200 may be joined (e.g., via brazing, diffusion bonding, or the like) to a plurality of other blade structures to yield a blade ring, which is then bonded to a separately-fabricated hub disk utilizing, for example, a Hot Isostatic Pressing (HIP) process. As a still further possibility, a rotor can be produced to include a number of blades similar to the airfoil 202, but integrally produced with the rotor hub as a single (e.g., forged and machined) component or blisk. Generally, then, it should be understood that the fan blade structure 200 is provided by way of non-limiting example and that the fan blade structure 200 (and the other airfoil structures described herein) may be fabricated utilizing various different manufacturing approaches. Such approaches may include, but are not limited to, casting and machining, three dimensional metal printing processes, direct metal laser sintering, Computer Numerical Control (CNC) milling of a preform or blank, and powder metallurgy, to list but a few examples.

The airfoil 202 may be conceptually divided into two opposing halves: i.e., a pressure side blade half 202' and a suction side blade half 202". The pressure side blade half 202' and the suction side blade half 202" are opposed in a thickness direction (corresponding to the X-axis of the coordinate legend 208 for the meridional view of FIG. 9). The blade halves 202', 202" may be integrally formed as a single part or monolithic piece such that the division or interface between the blade halves 202', 202" is a conceptual boundary, rather than a discrete physical boundary; however, the possibility that the blade halves 202', 202" may be separately fabricated (e.g., cast) and then joined in some manner is by no means precluded. Additionally, it should be appreciated that the boundary or interface between the blade halves 202', 202" need not precisely bisect the airfoil 202. Accordingly, the term "half," as appearing in this document, is utilized in a generalized sense to indicate that the airfoil 202 may be divided in two portions along an interface generally extending in the spanwise and chordwise directions. In an embodiment, the blade halves 202', 202" may have approximately equivalent volumes; that is, volumes that different by no more than 10%. In the illustrated example, the pressure side blade half 202' may generally correspond to the portion of the airfoil 202 bounded by the pressure side 214 and a camber line of the airfoil 202 (represented by dashed line that extends from the leading edge 218 to the trailing edge 220 in FIG. 9A), as extended through the airfoil 202 from the airfoil root 204 to the airfoil tip 206. The suction side blade half 202" may generally correspond to the portion of the airfoil 202 bounded by the suction side 216 and the camber line (represented by dashed line that extends from the leading edge 218 to the trailing edge 220 in FIG. 9A), as extended through the airfoil 202 from the airfoil root 204 to the airfoil tip 206.

The airfoil 202 also has a maximum thickness distribution that varies along both a span 230 (in a spanwise direction) and a plurality of chord lines 232 (in a chordwise direction) of the airfoil 202. The span 230 is a predefined height of the airfoil 202 that extends generally along the Y-axis (spanwise direction) from airfoil root 204 to airfoil tip 206. Each of the plurality of chord lines 232 is a line joining the leading edge 218 and the trailing edge 220 that extends generally along the Z-axis (chordwise direction) of the airfoil 202 for a predetermined length. The airfoil 202 has a predetermined length in the chordwise direction, and a predetermined height in the spanwise direction, which are each predefined based on the operating characteristics of the gas turbine engine 120. In this example, the span 230 is at 0% at the airfoil root 204 and is at 100% at the airfoil tip 206, and each of the plurality of chord lines 232 is at 0% at the leading edge 218 and is at 100% at the trailing edge 220. In the following examples, the airfoil 202 will be described as having a first chord line 232', a second chord line 232" and a third chord line 232'", but it will be understood that the airfoil 202 has a plurality of chord lines defined between the airfoil root 204 to the airfoil tip 206.

Figure 10:
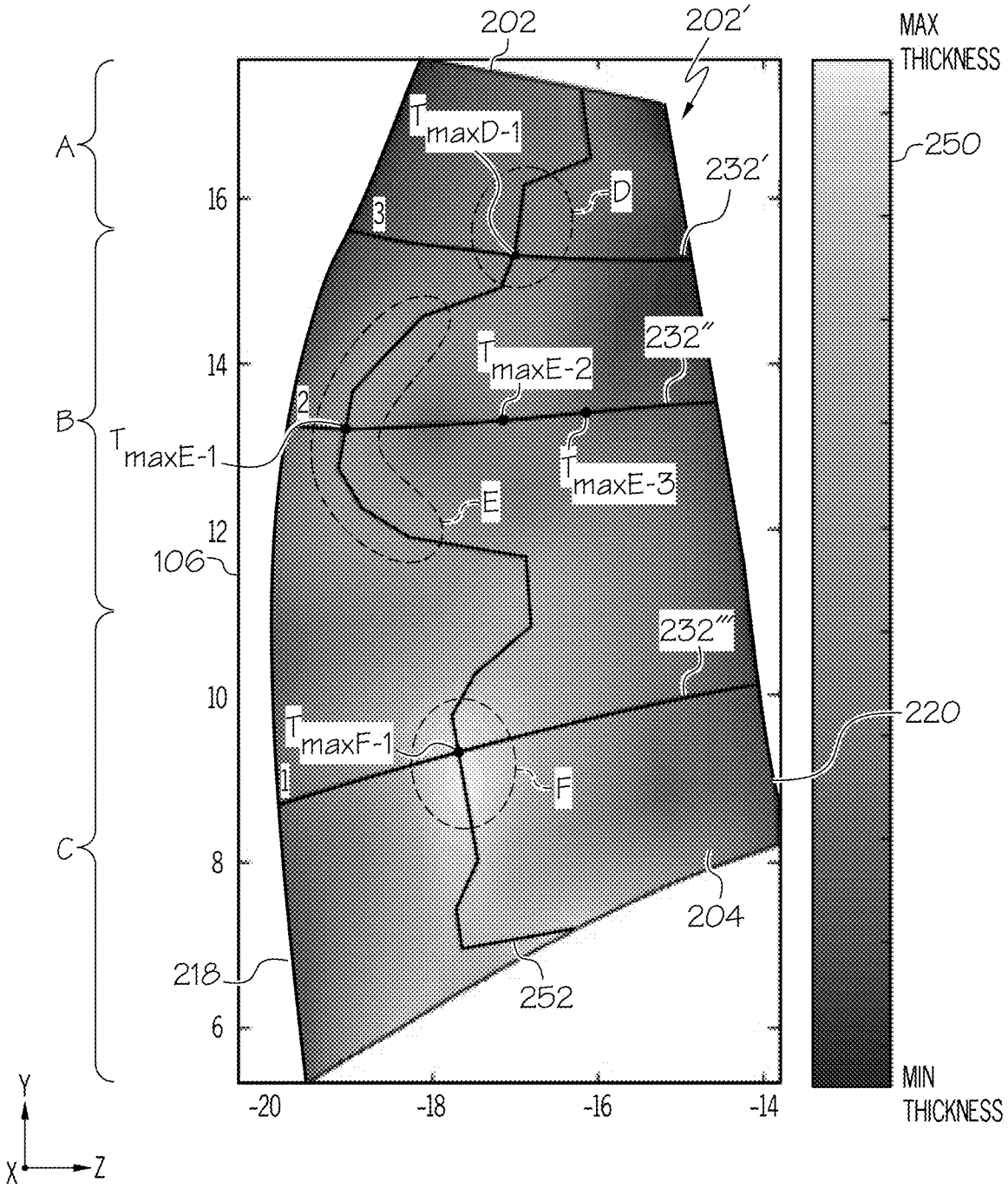
FIG. 10 is a meridional topographical view of the airfoil of FIG. 8 including thickness distributions in spanwise and chordwise directions, according to the various teachings of the present disclosure.

With reference to FIG. 10, a meridional topographical view illustrates the maximum thickness distributions in spanwise and chordwise directions of the airfoil 202. The illustrated thickness measurements are taken through a selected half of the airfoil 202, which may represent either the pressure side half 202' or the suction side half 202" of the airfoil 202. In this example, the pressure side half 202' is shown. The opposing half of the airfoil 202 (i.e. the suction side half 202") may have a similar multimodal thickness distribution, a different multimodal thickness distribution, or a non-multimodal thickness distribution. As indicated by a thickness key 250 appearing on the right side of FIG. 10, the local thickness of pressure side half 202' of the airfoil 202 fluctuates between a maximum global thickness and a minimum global thickness. Generally, the maximum global thickness is between about 0.5 inches (in.) and about 0.55 inches (in.); and the minimum global thickness is between about 0.05 inches (in.) and about 0.1 inches (in.). In other embodiments, maximum global thickness and minimum global thickness may be greater than or less than the aforementioned ranges. As used herein, the term "local" pertains to a particular spatial location or area on the airfoil 202 that does not encompass an entirety of the airfoil 202. Thus, a local maximum thickness is a maximum thickness at a particular location on the airfoil, which does not encompass an entirety of the airfoil 202.

In one example, the pressure side half 202' of the airfoil 202 includes a number of locally-thickened regions identified by graphics D-F. Each of a first local maximum thickness $T_{MAXD\text{-}1}$, a second local maximum thickness $T_{MAXE\text{-}1}$ and a third local maximum thickness $T_{MAXF\text{-}1}$ are defined within a respective one of the locally-thickened regions D-F. It should be noted that the locally-thickened regions D-F, while illustrated herein as a circular shape or crescent shape, are merely exemplary in shape, and the locally-thickened regions D-F may form any desired shape along the pressure side half 202' of the airfoil 202. While each of the first local maximum thickness $T_{MAXD\text{-}1}$, the second local maximum thickness $T_{MAXE\text{-}1}$ and the third local maximum thickness $T_{MAXF\text{-}1}$ are illustrated herein as a point within the respective one of the regions D-F, it will be understood that one or more of the first local maximum thickness $T_{MAXD\text{-}1}$, the second local maximum thickness $T_{MAXE\text{-}1}$ and the third local maximum thickness $T_{MAXF\text{-}1}$ may also comprise an area within the respective one of the regions D-F.

In one example, the airfoil 202 has the first local maximum thickness $T_{MAXD\text{-}1}$ defined within region D at blade portion A, which is between about 85% of the span 230 to about 100% of the span 230 or at the airfoil tip 206. In one example, the first local maximum thickness $T_{MAXF\text{-}1}$ is about 0.2 inches (in.) to about 0.15 inches (in.). The airfoil 202 has the second local maximum thickness $T_{MAXE-1}$ defined within region E at blade portion B, which is between about 40% of the span 230 to about 85% of the span 230. In one example, the second local maximum thickness $T_{MAXE-1}$ is about 0.35 inches (in.) to about 0.27 inches (in.). The airfoil 202 has the third local maximum thickness $T_{MAXF-1}$ defined within region F at blade portion C, which is between about 0% of the span 230 at the airfoil root 204 to about 40% of the span 230. In one example, the third local maximum thickness $T_{MAXF-1}$ is about 0.5 inches (in.) to about 0.4 inches (in.).

Thus, generally, each of the first local maximum thickness $T_{MAXD-1}$, the second local maximum thickness $T_{MAXE-1}$ and the third local maximum thickness $T_{MAXF-1}$ are different. Generally, the first local maximum thickness $T_{MAXD-1}$ is less than the second local maximum thickness $T_{MAXE-1}$ and the third local maximum thickness $T_{MAXF-1}$ as the blade portion A may be protected by a portion of a nacelle associated with the gas turbine engine 120. The second local maximum thickness $T_{MAXE-1}$ is generally less than the third local maximum thickness $T_{MAXF-1}$. In addition, in this example, each of the first local maximum thickness $T_{MAXD-1}$, the second local maximum thickness $T_{MAXE-1}$ and the third local maximum thickness $T_{MAXF-1}$ has a unique (Z, Y) coordinate location value in a coordinate system defined by the chordwise direction and the spanwise direction (as illustrated with the coordinate legend 208) on the pressure side half 202' of the airfoil 202.

As shown in FIG. 10, each of the first local maximum thickness $T_{MAXD-1}$, the second local maximum thickness $T_{MAXE-1}$ and the third local maximum thickness $T_{MAXF-1}$ are defined along a particular one of the chord lines 232', 232", 232'" associated with the pressure side half 202' of the airfoil 202, with each of the chord lines 232', 232", 232'" spaced apart from each other along the span 230 of the airfoil 202. A line 252 is overlaid onto the principal surface of airfoil 202 and connects the maximum global thickness for each chord of the airfoil 202 between airfoil root 204 and airfoil tip 206. Starting from airfoil root 204 and moving outwardly toward airfoil tip 206, the chord-to-chord maximum global thickness line 252 initially moves toward the leading edge 218 when transitioning between the third local maximum thickness $T_{MAXF-1}$ at the region F and the second local maximum thickness $T_{MAXE-1}$ at the region E; and transitions from the second local maximum thickness $T_{MAXE-1}$ at the region E toward trailing edge 220 to the first local maximum thickness $T_{MAXD-1}$ at the region D before reaching the airfoil tip 206. The mechanical attributes enhanced by the first local maximum thickness $T_{MAXD-1}$ at region D, the second local maximum thickness $T_{MAXE-1}$ at region E and the third local maximum thickness $T_{MAXF-1}$ at region F may be interrelated such that each region D-F impacts multiple different mechanical parameters of the airfoil 202. The relatively large second local maximum thickness $T_{MAXE-1}$ at region E favorably increases the fracture and deformation resistance of airfoil 202 when subject to an encounter with a foreign object, such as a bird strike or other high impact force.

Figure 11:
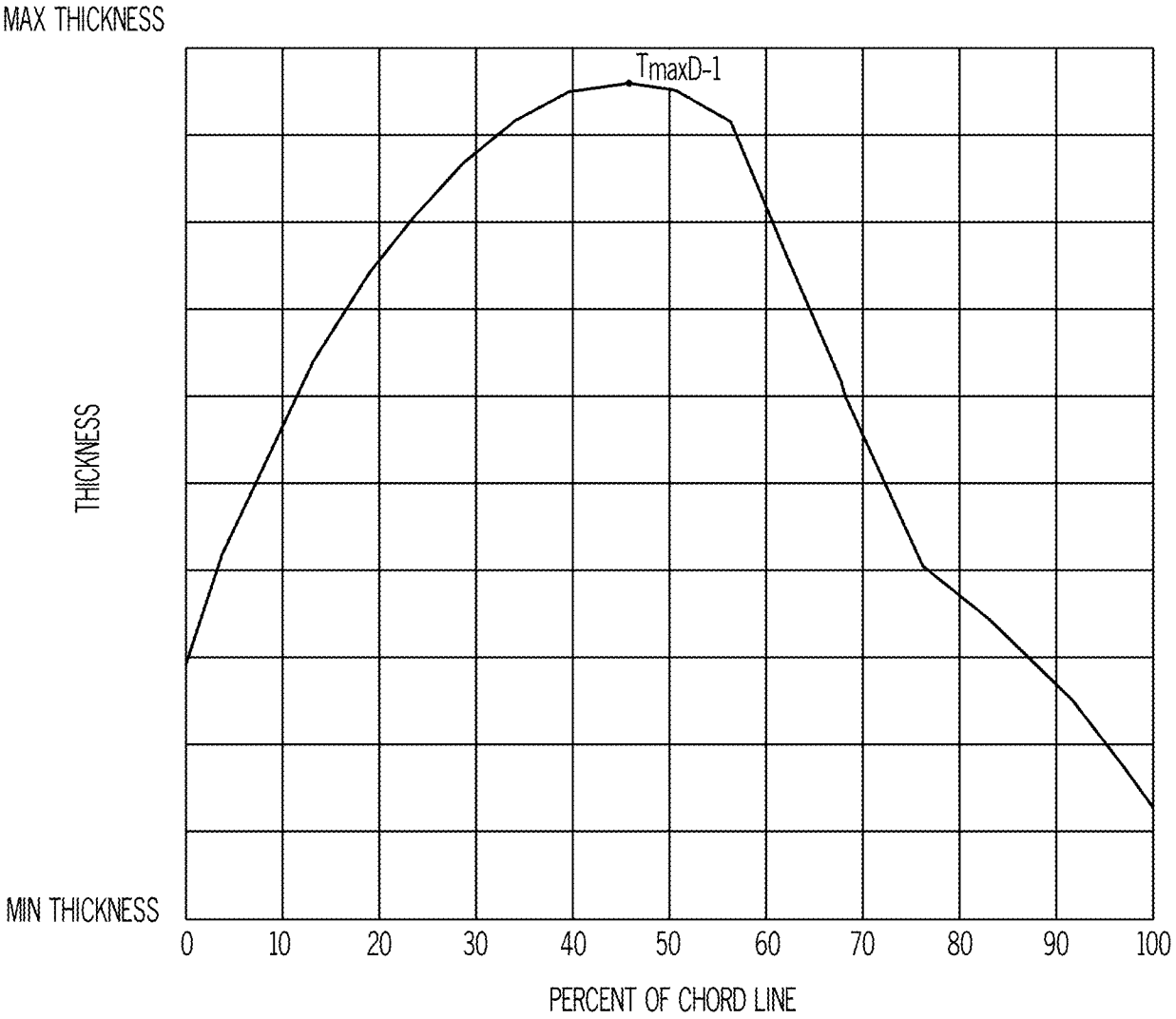
FIG. 11 is a graph of percent of chord line (abscissa) versus airfoil thickness (ordinate) illustrating a chordwise position of a first local maximum thickness, as taken in a chordwise direction along a first selected chord line (identified in FIG. 10)

In one example, the first local maximum thickness $T_{MAXD-1}$ is defined within the blade portion A at the region D, which is between about 40% to about 60% of the chord line 232'. Referring jointly to FIGS. 10 and 11, the chordwise thickness distribution of the airfoil 202 along the chord line 232' contains a first local chordwise thickness maxima (identified in FIG. 11 as "$T_{MAXD-1}$"). The lower edge of the graph in FIG. 11 corresponds to a length of the chord line 232' from 0% of the chord line 232' (at the leading edge 218) to 100% of the chord line 232' (at the trailing edge 220). As shown, the first local maximum thickness $T_{MAXD-1}$ for the airfoil 202 in the blade portion A is at the first local chordwise thickness maxima, which is located between about 40% to about 60% of the chord line 232'.

Figure 12:
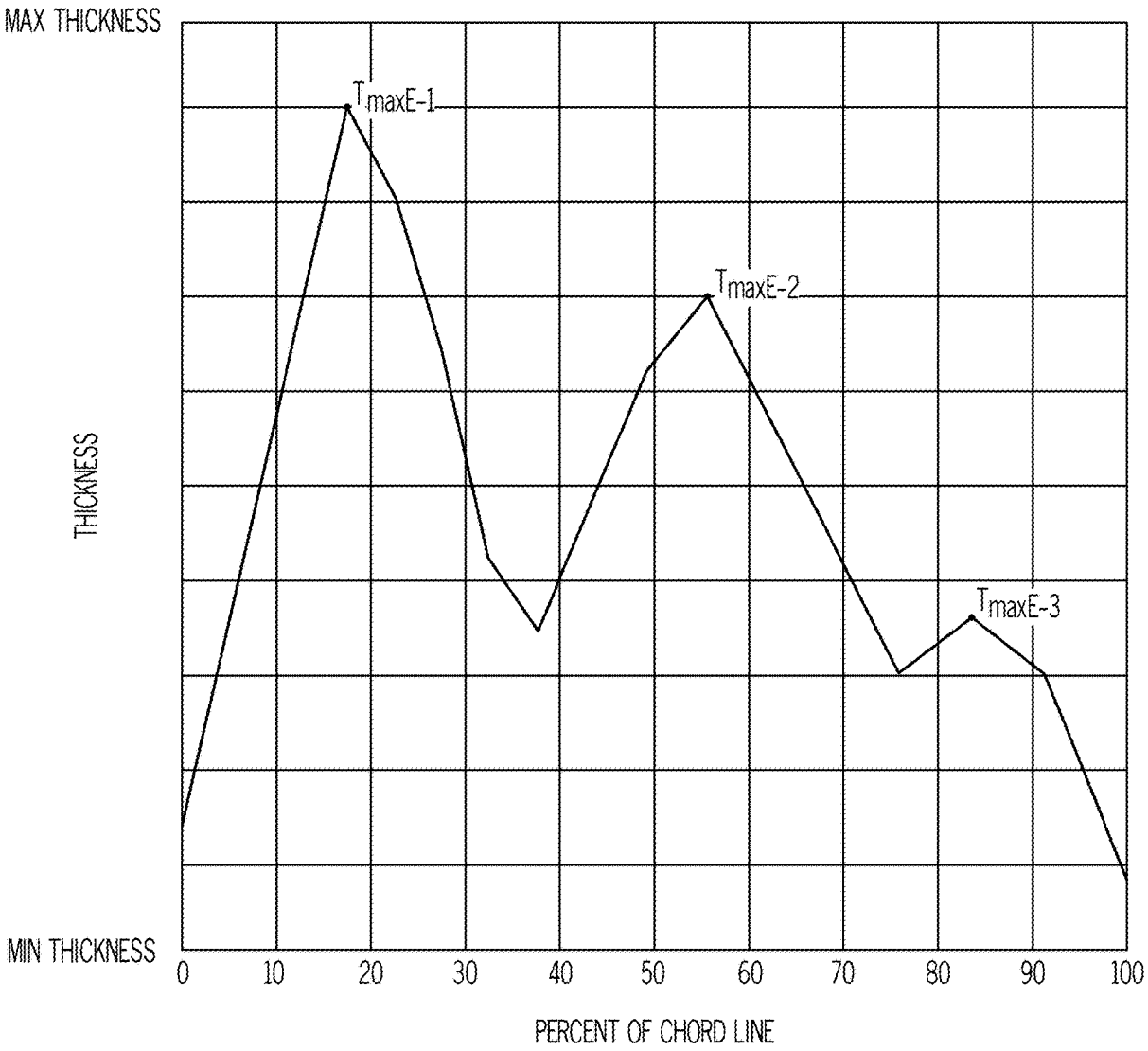
FIG. 12 is a graph of percent of chord line (abscissa) versus airfoil thickness (ordinate) illustrating a chordwise position of a second local maximum thickness, as taken in a chordwise direction along a second selected chord line (identified in FIG. 10)

The second local maximum thickness $T_{MAXE-1}$ is defined within the blade portion B at the region E, which is about 10% to about 30% of the chord line 232". Referring jointly to FIGS. 10 and 12, the chordwise thickness distribution of the airfoil 202 along the chord line 232" contains a first local chordwise thickness maxima (identified in FIG. 12 as "$T_{MAXE-1}$"); a second local chordwise thickness maxima (identified in FIG. 12 as "$T_{MAXE-2}$"); and a third local chordwise thickness maxima (identified in FIG. 12 as "$T_{MAXE-3}$"). The lower edge of the graph in FIG. 12 corresponds to a length of the chord line 232" from 0% of the chord line 232" (at the leading edge 218) to 100% of the chord line 232" (at the trailing edge 220). As shown, the second local maximum thickness $T_{MAXE-1}$ for the airfoil 202 in the blade portion B is at the first local chordwise thickness maxima, which is located between about 10% to about 30% of the chord line 232".

Figure 13:
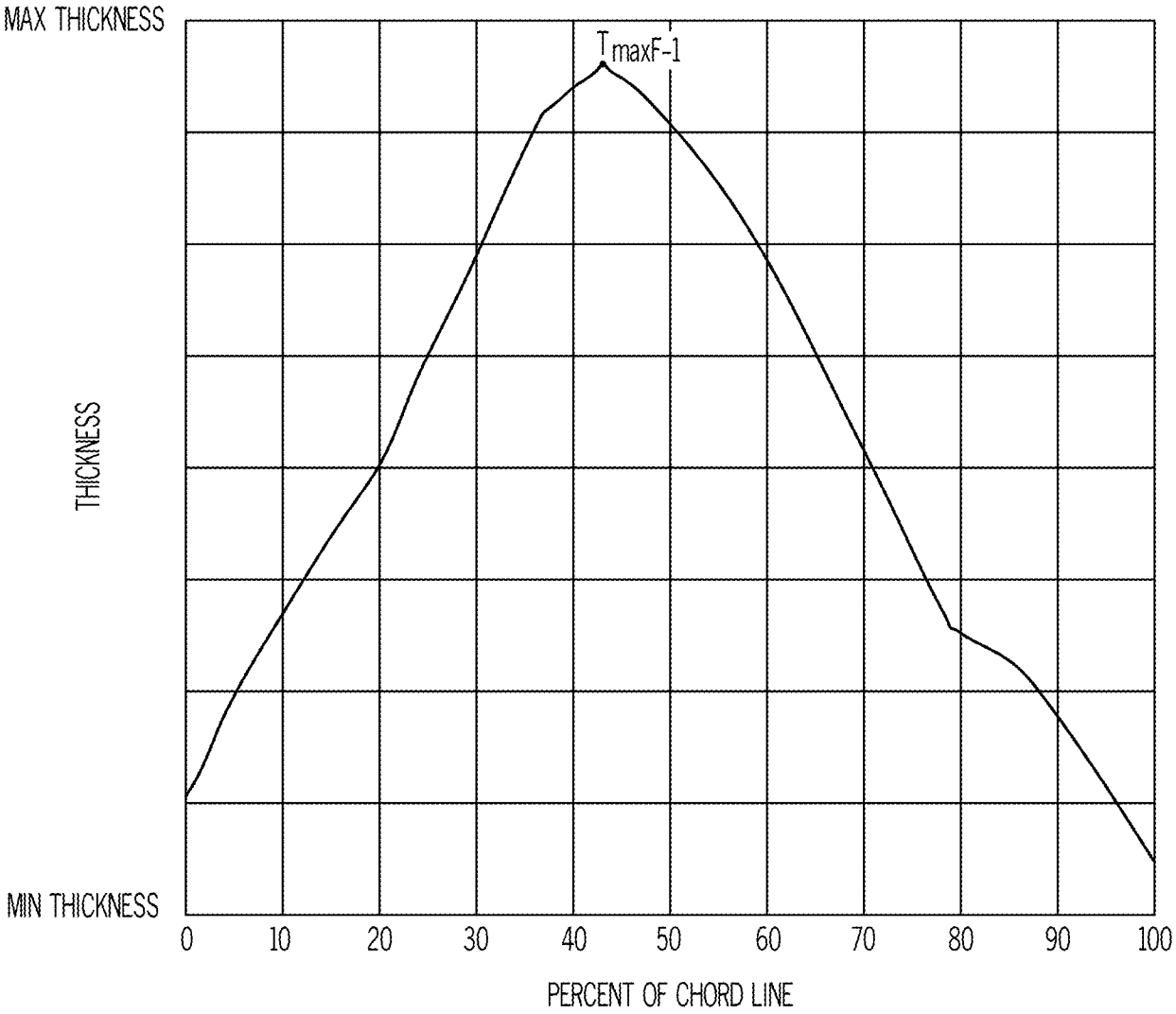
FIG. 13 is a graph of percent of chord line (abscissa) versus airfoil thickness (ordinate) illustrating a chordwise position of a third local maximum thickness, as taken in a chordwise direction along a third selected chord line (identified in FIG. 10).

The third local maximum thickness $T_{MAXF-1}$ is defined within blade portion C at the region F, which is about 40% to about 60% of the chord line 232'". Referring jointly to FIGS. 10 and 13, the chordwise thickness distribution of the airfoil 202 along the chord line 232'" contains a first local chordwise thickness maxima (identified in FIG. 13 as "$TMAX_{F-1}$"). The lower edge of the graph in FIG. 13 corresponds to a length of the chord line 232'" from 0% of the chord line 232'" (at the leading edge 218) to 100% of the chord line 232'" (at the trailing edge 220). As shown, the third local maximum thickness $TMAX_{F-1}$ for the airfoil 202 in the blade portion C is at the first local chordwise thickness maxima, which is located between about 40% to about 60% of the chord line 232'".

Thus, in this example, the second local maximum thickness $T_{MAXE-1}$ is defined at region E on the chord line 232" so as to be offset from the first local maximum thickness $T_{MAXD-1}$ defined at region D on the chord line 232', and also offset from the third local maximum thickness $T_{MAXF-1}$ defined at region F on the chord line 232'". In this example, the second local maximum thickness $T_{MAXE-1}$ is defined at region E on the chord line 232" is offset from the first local maximum thickness $T_{MAXD-1}$ defined at region D and the third local maximum thickness $T_{MAXF-1}$ defined at region F along the Z-axis (chordwise direction) toward the leading edge 218.

By defining the second local maximum thickness $T_{MAXE-1}$ at region E, which is positioned on the chord line 232" at about 10% to about 30% and positioned on the span 230 at about 40% to about 85%, the second local maximum thickness $T_{MAXE-1}$ provides robustness to the airfoil 202, while optimizing a weight of the airfoil 202. In one example, the multimodal thicknesses of the airfoil 202 provide for about a 30% reduction in damage from foreign object encounters, without increasing a weight of the airfoil 202.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A fan blade for a gas turbine engine, comprising:

an airfoil extending from a root to a tip in a spanwise direction and having a leading edge and a trailing edge in a chordwise direction, with a span that extends from the root to the tip and a first chord line that extends from the leading edge to the trailing edge, the first chord line at 0% at the leading edge and at 100% at the trailing edge, the airfoil having a first local maximum thickness defined between 85% of the span to the tip, a second local maximum thickness defined between 40% to 85% of the span and a third local maximum thickness defined between the root to 40% of the span, the second local maximum thickness positioned at 10% to 30% of the first chord line so as to be spaced apart from the leading edge and offset from the first local maximum thickness in the chordwise direction toward the leading edge; and wherein each of the first local maximum thickness, the second local maximum thickness and the third local maximum thickness have a different value.

2. The fan blade of claim 1, wherein the first local maximum thickness is positioned at 40% to 60% of a second chord line, the second chord line at 0% at the leading edge and at 100% at the trailing edge.

3. The fan blade of claim 1, wherein the third local maximum thickness is positioned at 40% to 60% of a third chord line, the third chord line at 0% at the leading edge and at 100% at the trailing edge.

4. The fan blade of claim 1, wherein the first local maximum thickness is less than the second local maximum thickness and the third local maximum thickness.

5. The fan blade of claim 1, wherein the second local maximum thickness is less than the third local maximum thickness.

6. The fan blade of claim 1, wherein the second local maximum thickness is offset from the third local maximum thickness in the chordwise direction toward the leading edge.

7. The fan blade of claim 1, wherein each of the first local maximum thickness, the second local maximum thickness and the third local maximum thickness have a unique coordinate location value in the chordwise direction and the spanwise direction.

8. A fan blade for a gas turbine engine, comprising:

an airfoil extending from a root to a tip in a spanwise direction and having a leading edge and a trailing edge in a chordwise direction, with a span that extends from the root to the tip, a first chord line and a second chord line that each extend from the leading edge to the trailing edge, the first chord line and the second chord line at 0% at the leading edge and at 100% at the trailing edge, the airfoil having a first local maximum thickness defined between 85% of the span to the tip, a second local maximum thickness defined between 40% to 85% of the span and a third local maximum thickness defined between the root to 40% of the span, the second local maximum thickness positioned at 10% to 30% of the first chord line so as to be spaced apart from the leading edge and the first local maximum thickness is positioned at 40% to 60% of the second chord line such that the second local maximum thickness is offset from the first local maximum thickness in the chordwise direction toward the leading edge and the first local maximum thickness is less than the second local maximum thickness.

9. The fan blade of claim 8, wherein the third local maximum thickness is positioned at 40% to 60% of a third chord line, the third chord line at 0% at the leading edge and at 100% at the trailing edge.

10. The fan blade of claim 8, wherein the first local maximum thickness is less than the third local maximum thickness.

11. The fan blade of claim 8, wherein the second local maximum thickness is less than the third local maximum thickness.

12. The fan blade of claim 8, wherein the second local maximum thickness is offset from the third local maximum thickness in the chordwise direction toward the leading edge.

13. The fan blade of claim 8, wherein each of the first local maximum thickness, the second local maximum thickness and the third local maximum thickness have a unique coordinate location value in the chordwise direction and the spanwise direction.

14. The fan blade of claim 8, wherein the fan blade is one of a plurality of fan blades coupled to a rotor of a fan of the gas turbine engine.

15. A gas turbine engine, comprising:

a blade having an airfoil extending from a root to a tip in a spanwise direction and having a leading edge and a trailing edge in a chordwise direction, with a span that extends from the root to the tip, a first chord line and a second chord line that each extend from the leading edge to the trailing edge, the first chord line and the second chord line at 0% at the leading edge and at 100% at the trailing edge, the airfoil having a first local maximum thickness defined between 85% of the span to the tip, a second local maximum thickness defined between 40% to 85% of the span and a third local maximum thickness defined between the root to 40% of the span, the second local maximum thickness positioned at 10% to 30% of the first chord line so as to be spaced apart from the leading edge and the third local maximum thickness is positioned at 40% to 60% of the second chord line such that the second local maximum thickness is offset from the third local maximum thickness in the chordwise direction toward the leading edge and the second local maximum thickness is less than the third local maximum thickness, the blade including a platform coupled to the airfoil and adapted to couple the blade to a rotor associated with the gas turbine engine.

16. The gas turbine engine of claim 15, wherein the first local maximum thickness is positioned at 40% to 60% of a third chord line, the third chord line at 0% at the leading edge and at 100% at the trailing edge.

17. The gas turbine engine of claim 15, wherein the first local maximum thickness is less than the third local maximum thickness.

18. The gas turbine engine of claim 15, wherein the second local maximum thickness is greater than the first local maximum thickness.

19. The gas turbine engine of claim 15, wherein the second local maximum thickness is offset from the first local maximum thickness in the chordwise direction toward the leading edge.

20. The gas turbine engine of claim 15, wherein each of the first local maximum thickness, the second local maximum thickness and the third local maximum thickness have a unique coordinate location value in the chordwise direction and the spanwise direction.

* * * * *